United States Patent [19]

Becka et al.

[11] Patent Number: 4,679,269

[45] Date of Patent: Jul. 14, 1987

[54] HEEL LASTING MACHINE

[75] Inventors: Michael M. Becka, Nashua, N.H.; Walter Vornberger, Tewksbury, Mass.

[73] Assignee: International Shoe Machine Corporation, Nashua, N.H.

[21] Appl. No.: 845,089

[22] Filed: Mar. 27, 1986

[51] Int. Cl.[4] ..... A43D 21/16; A43D 21/00

[52] U.S. Cl. ..... 12/10.5; 12/12; 12/12.5

[58] Field of Search ..... 12/8.8, 8.81, 10.21, 12/10.5, 10.8, 11.3, 12, 12.3, 12.5, 14.5

[56] References Cited

U.S. PATENT DOCUMENTS

| | | | |
|---|---|---|---|
| 3,292,191 | 12/1966 | Kamborian | 12/12.5 |
| 3,320,626 | 5/1967 | Kamborian et al. | 12/10.5 |
| 3,436,779 | 4/1969 | Leonhardt | 12/10.5 |
| 3,444,571 | 5/1969 | Harriman et al. | 12/12.5 |
| 3,675,260 | 7/1972 | Kamborian et al. | 12/12.5 |
| 4,400,839 | 8/1983 | Hartshorn et al. | 12/12.5 |
| 4,553,281 | 11/1985 | Vornberger | 12/12 |

OTHER PUBLICATIONS

International Shoe Machine Bulletin 983, "Heel Molder and Laster Model A".

*Primary Examiner*—Werner H. Schroeder
*Assistant Examiner*—Steven N. Meyers
*Attorney, Agent, or Firm*—Robert Shaw

[57] ABSTRACT

A heel lasting machine to receive a footwear upper assembly that includes a last, an insole on the last bottom and an upper draped about the last with a margin extending upwardly from the insole, the last having a spindle hole. The machine includes two stations; each station includes a heel post or spindle having a last pin to insert into the spindle hole and a toe rest to receive the toe of the upper assembly. A single adhesive applicator applies adhesive to the heel region of the upwardly directed insole of both upper assemblies. All operations of the machine are computer controlled. A mechanism is provided to locate the nozzle of the adhesive applicator in its rest position relative to the heel region, despite variations in the placement of the spindle hole. A mechanism to assure a snug fit of the heel of the upper about the heel of the last is also provided. Once the upper is fitted about the last the upper assembly is pressed onto the toe rest. Thereafter further machine elements further secure the upper assembly to the machine, a U-shaped ribbon of adhesive is applied to an appropriate location at the heel region of the insole and the upper margin is wiped thereon.

19 Claims, 20 Drawing Figures

* CEMENT CYCLE AND WIPERS ARE CONTROLLED BY THE STD. BUS COMPUTER

HEEL LASTING MACHINE

The present invention relates to lasting machines used in the footwear industry.

Attention is called to U.S. Pat. No. 3,320,626 (Kamborian et al) and the art cited therein, as well as 3,963,840 (Vornberger). See also International Shoe Machine Bulletin 983.

The heel molder and laster shown in the above-mentioned bulletin is a single station machine which is used to provide an initial step in a shoe (or other footwear) lasting operation. (In the discussion herein emphasis is placed on shoes, but the present invention is useful in the more general field of footwear lasting.) The machine shown in the bulletin is used to adhere the heel portion of an upper onto the outer bottom edge of an insole. An upper assembly that includes a last, a shoe upper and an insole is placed bottom up onto a last pin of the machine. The machine operator positions the assembly (insole directed upward) onto the last pin and aligns the upper upon the last. A heel hold-down is moved into engagement of the heel portion of the upper assembly to maintain the assembly in position and an insole hold-down is applied to the insole to keep the insole pressed against the bottom of the last. At this juncture the upper is positioned with respect to the last and the upper assembly is properly positioned for the further operations that follow. The further operations include use of breast line pincers that grasp upwardly extending margins of the upper and stretch the upper with an upward and inward motion, and pull the upper snugly against the shank region of the last, thereby insuring a tight topline. Forepart pincers, in the meantime, have applied forward and upward tension on the upper between the ball portion thereof and the toe portion. At that stage a heel pad engages the heel of the upper and wraps the upper about the last (at the heel region). The heel hold-down is withdrawn and thermoplastic adhesive is applied automatically to the upper assembly by way of a rotary valve extruder that sprays adhesive into the corner region of the heel portion of the upper assembly. Then wipers close to form a flat heel and the upper assembly, with the heel portion attached to the insole, is automatically ejected into a catch pan. The machine, by appropriate adjustment, accommodates both left and right shoe upper assemblies.

It is an object of the present invention to provide a heel lasting machine having mechanisms to apply an adhesive (e.g., thermoplastic) in a very precise pattern at the heel portion of a shoe upper.

Another object is to provide a machine with mechanisms to apply such an adhesive precisely and successfully to the heel portion of a first shoe upper assmebly (e.g., an upper assembly of a left shoe) and a second shoe upper assembly (e.g., an upper assembly of a right shoe).

As is noted above and explained later in greater detail, the last is received by a last pin as an initial step. In fact, the last has a last spindle hole that receives the last pin. The location of that last spindle hole can vary as much as one-half inch from one last to the next, rendering positioning of the last in the machine very impresise. This situation is particularly vexing with respect to longitudinal positioning of the upper assembly in the machine. Accordingly, it is a still further object of the present invention to provide a way to locate in space the exact position of the back of the heel portion of the upper assembly relative to the adhesive applicator, despite variations in location of the last spindle hole from last to last.

These and still further objects are addressed hereinafter.

The foregoing objects are addressed generally, in a heel lasting machine to receive two footwear assemblies, each assembly including a last, an insole on the last bottom and an upper draped about the last with a margin extending upwardly from the insole, the last having a spindle hole, which machine comprises two stations, each station including: a heel post having a last pin that is received by the spindle hole; a pincers mechanism operable to grasp the margin at each side of the upper assembly and operable to pull (or draw) the upper in the direction of the toe of the upper assembly to stretch the heel part of the upper about the heel portion of the last, which heel portion is curvilinear, the pincers mechanism being adapted to pull (or draw) the upper and cause the upper to conform to the curvilinear shape of the heel portion of last; a toe rest to receive the toe of the upper assembly; a mechanism to pivot the upper assembly to press the upper assembly upon the toe rest to secure the upper assembly mechanically with respect to the machine; a hold-down that moves into position to establish the height position of the insole in the context of the machine; a mechanism to move the heel post upward to effect contact between the hold-down and the insole; a heel-pad actuating mechanism that is operable to move a heel pad into contact with and, later, in firm engagement with the upper assembly at the heel portion of the assembly; an adhesive applying unit that includes a single nozzle operable to apply a ribbon of adhesive in a predetermined pattern to the heel portion of the upper assembly; and a mechanism to establish an exact (i.e., within acceptable tolerances) spatial position between the nozzle, at its initial or rest position, and the heel portion of the upper assembly to assure that the ribbon of adhesive is applied at an appropriate position with respect to the heel portion of the upper assembly despite variations as to the position of the spindle hole in the last.

The invention is hereinafter described with reference to the accompanying drawing in which.

Figure 1:
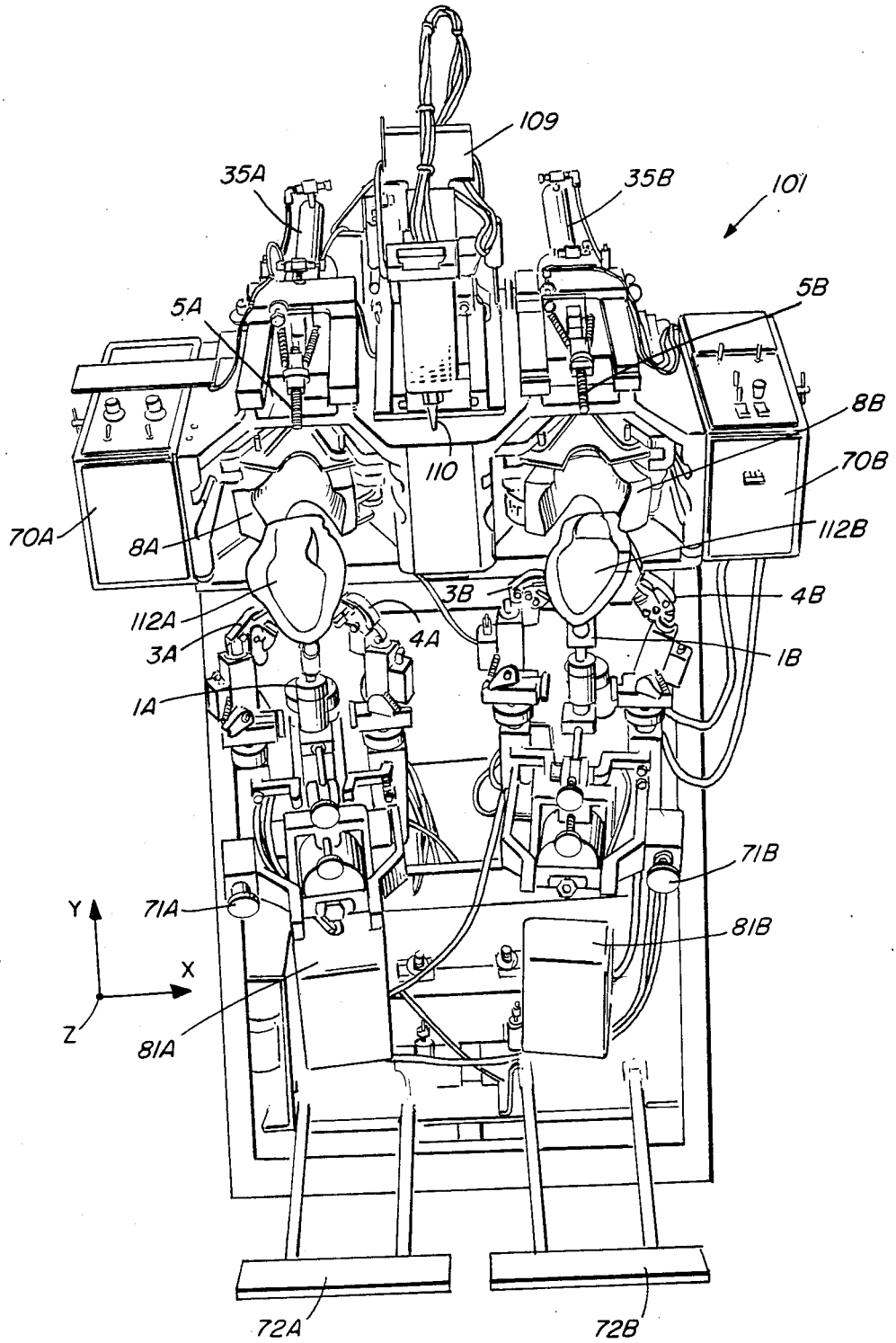
FIG. 1 is a front view of a two-station heel lasting machine with a left shoe upper assembly and a right shoe upper assembly in place, each assembly including a last, a shoe upper draped about the last and an insole at the last bottom.
Figure 2:
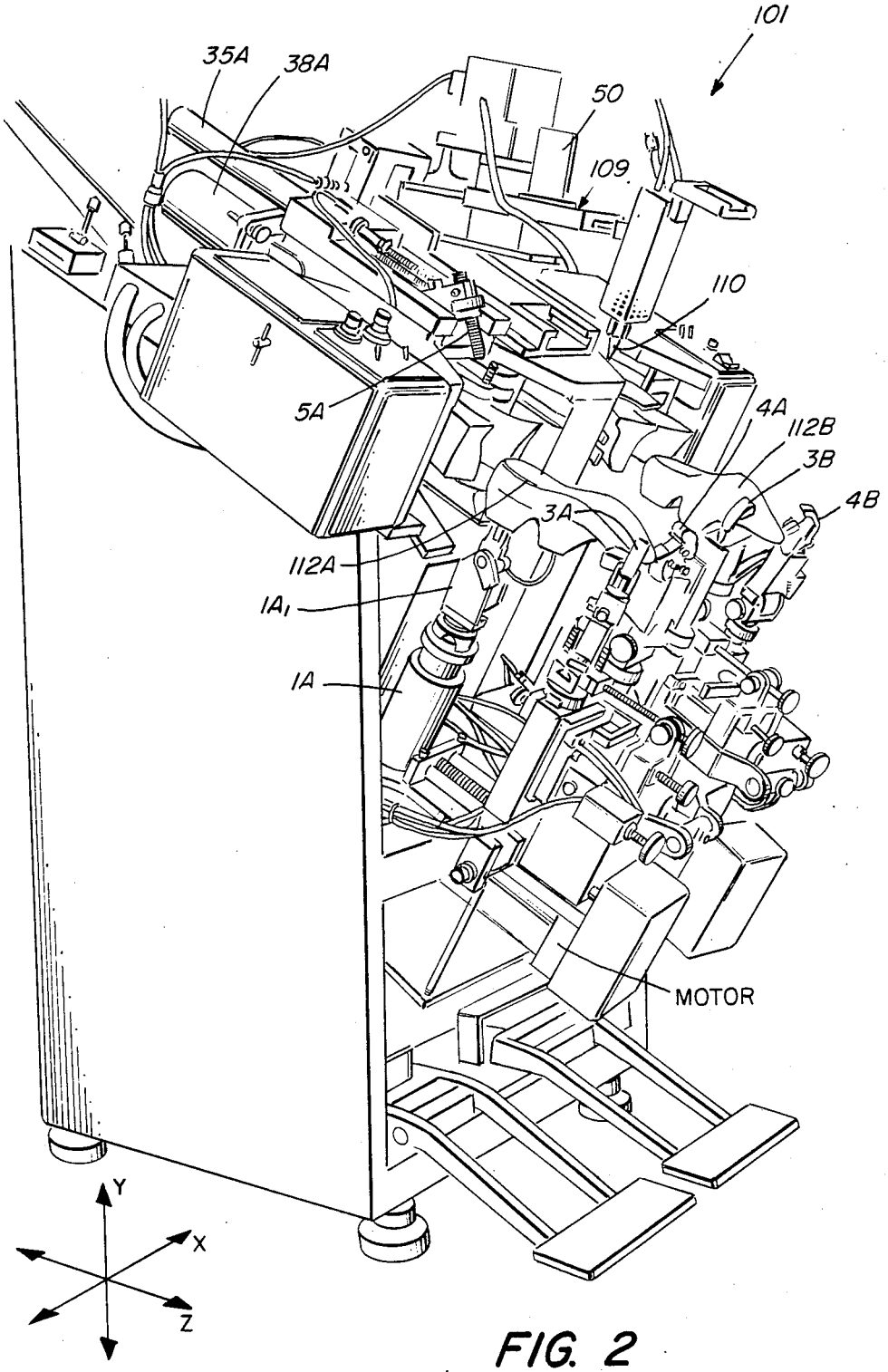
FIG. 2 is an isometric view of the machine in FIG. 1 viewed from the left side thereof.
Figure 10:
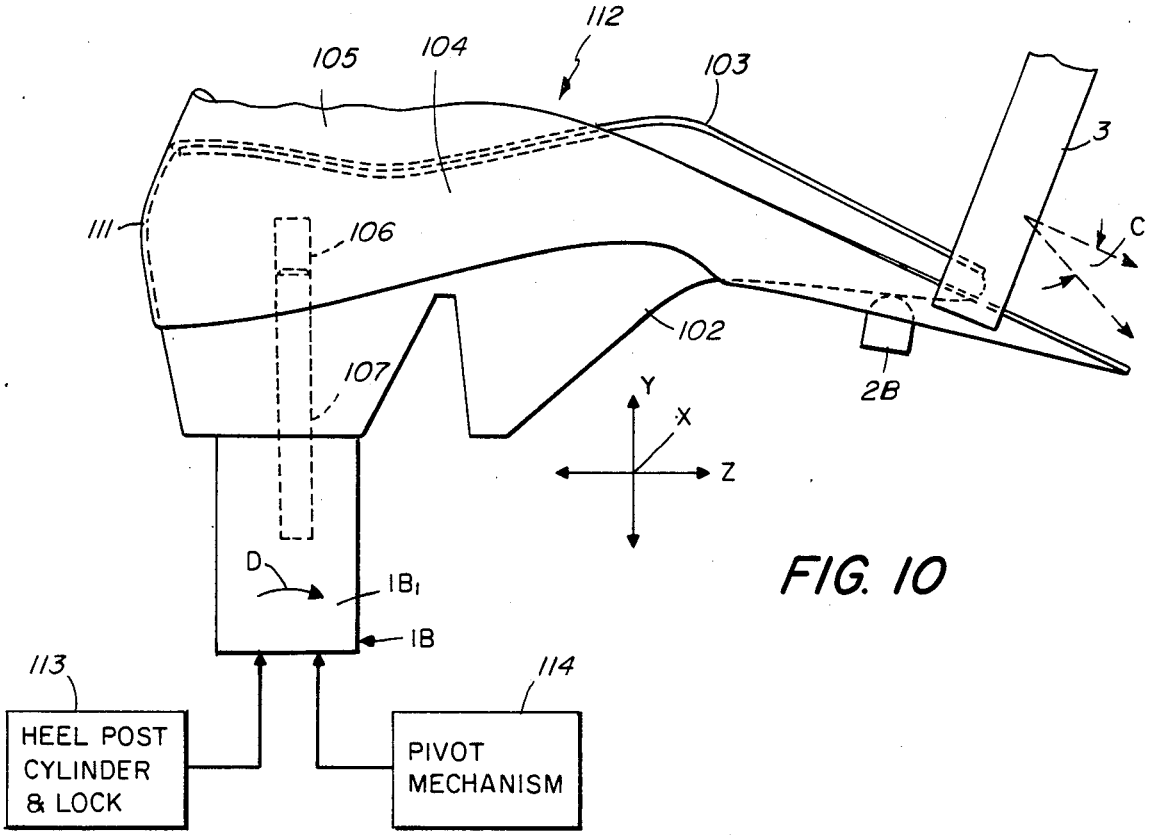
FIG. 10 is a side view, partially diagrammatic form, of a small part of the machine of FIG. 1 to show the right shoe upper assembly and pincers to stretch the upper about the heel portion of the last.
Figure 11:
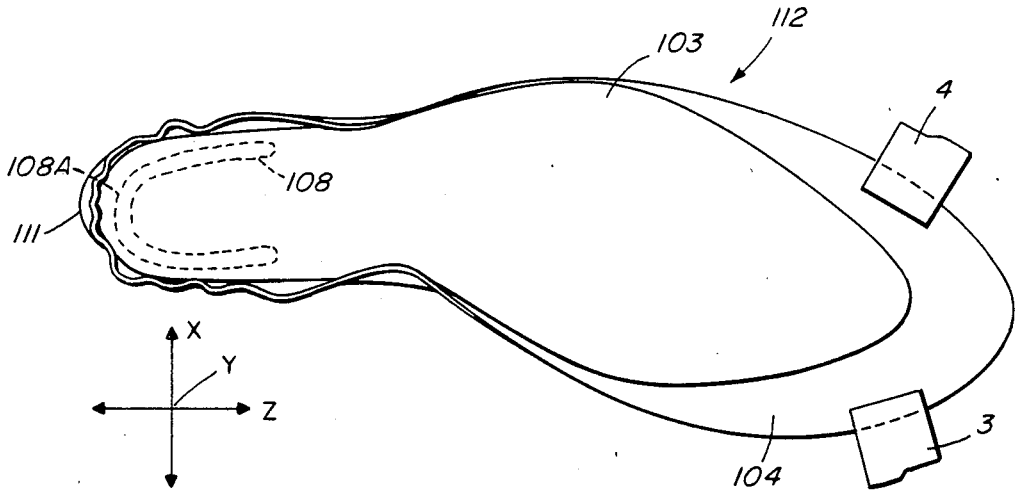
FIG. 11 is a plan view of the upper assembly of FIG. 10 showing a pair of pincers stretching the shoe upper about the heel portion of the last.

Turning now to the figures, there is shown at 101 in FIGS. 1 and 2 a two-station heel lasting machine to receive two shoe assemblies 112A and 112B, each assembly including, as shown in FIGS. 10 and 11 (where the upper assembly is is numbered 112), a last 102, an insole 103 on the last bottom and an upper 104 draped about the last with a margin 105 extending upwardly from the insole 103. The last has a spindle hole 106 to receive a last pin 107. As is pointed out above, longitudinal placement (i.e., ± Z-direction in FIG. 10) of the spindle hole 106 can vary as much as one-half inch from last to last. Yet the U-shaped ribbon hot-melt adhesive shown in dotted form at 108 in FIG. 11 and elsewhere must be positioned rather precisely onto the heel region, for example, of the insole 103 in preparation for wiping, as later discussed. Most of the machine parts on the right side of the machine 101 in FIG. 1 are a mirror image of the parts on the left side thereof, but the adhesive applicator marked generally 109 in FIG. 1 serves to apply adhesive to both the shoe assemblies 112A and 112B through a nozzle 110 which moves to the left and then to the right for that purpose. According to the present teaching, as discussed in detail below, a mechanism is provided in the machine 101 to locate the back-most point marked 111, of the curvilinear back of the shoe upper assembly in FIGS. 10 and 11, the back-most point shown at 108A of the ribbon 108 then being positioned a predetermined distance to the right of the point 111 in FIG. 11.

The machine operator stands in front of the heel lasting machine 101 in FIG. 1 looking in the minus Z-direction. Directions extending toward the operator (i.e., plus Z-direction) will be regarded as "forward" and directions extending away from the operator will be designated as "rearward". The front of the machine is closest to the operator and the back of the machine is furthermost from the operator. The Z-direction in the figures is horizontal, but the upper assembly 112B (112A) in FIG. 1 and the other figures and machine parts that operate on the upper assembly are inclined about thirty degrees to the horizontal; nevertheless these parts are referred to herein for convenience as Z-directed.

Several issues are emphasized in this specification: the identification of the spatial location of the heel of the upper assembly relative to the parts of the machine 101 that perform functions on the upper assembly to permit proper application of the ribbon of adhesive relative to the heel portion; the height or vertical location of the heel relative to wipers; and the stretching of the upper about the heel part of the last to cause the heel of the upper to conform to the heel of the last.

Figure 12:
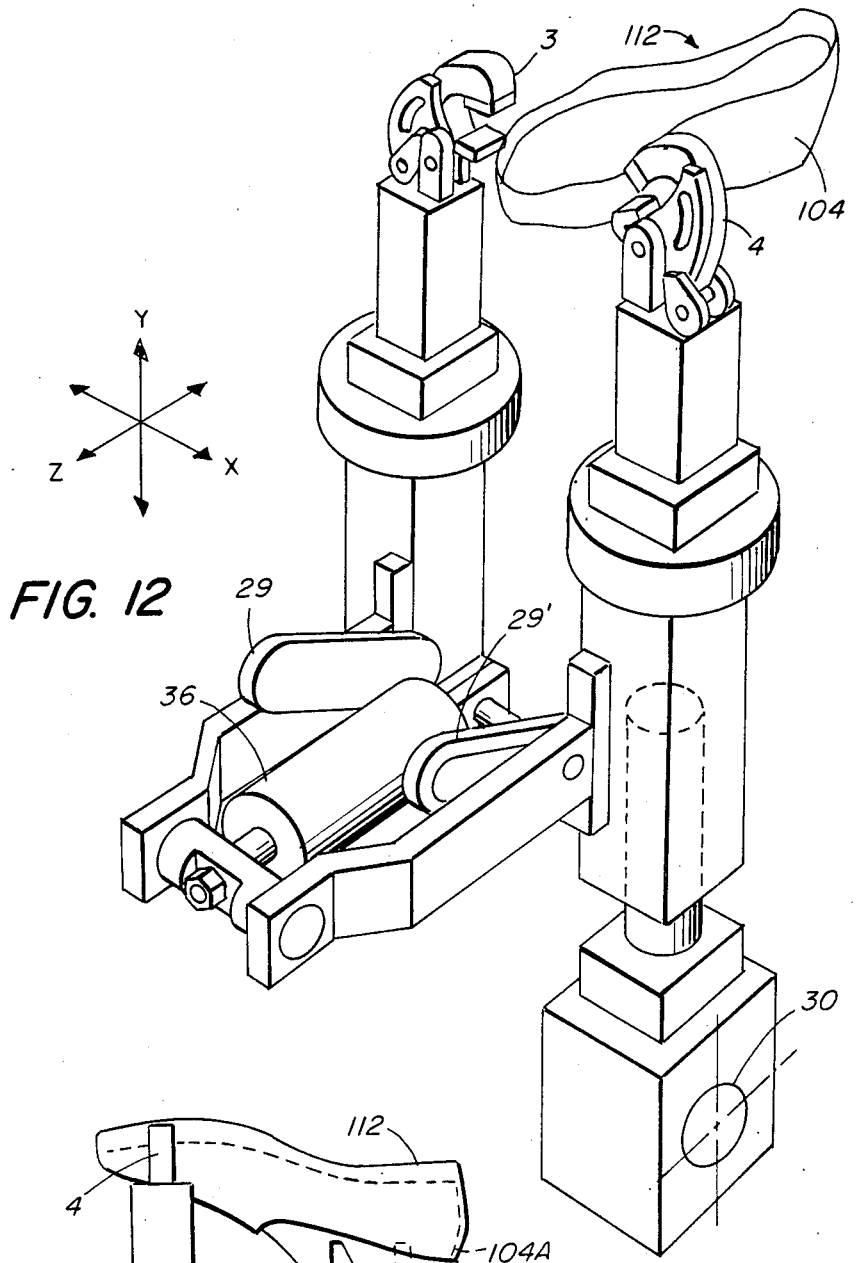
FIG. 12 is an enlarged isometric view showing details of the right-side pincers in earlier figures with a mechanism to change the draw angle of the pincers.

The machine 101 has two stations to receive the footwear upper assemblies 112A and 112B like the upper assembly 112 in FIG. 12. In general, as above noted, the right side of the machine 101 is a mirror image of the left side; machine parts on the left are given a number designation plus the letter "A", those on the right are given a number designation plus the letter "B". The nozzle assembly marked 110 functions with respect to both the left and the right station.

Most of the discussion below is made with reference to the right side of the machine 101. Where a part on the right side is discussed by number and letter, the corresponding left-side number and letter are generally placed in parentheses without further comment merely to incorporate numbering in the drawing into the specification.

Each station includes a heel post or spindle 1B (1A) having a last pin, like the pin 107 in FIG. 10, that is received by a spindle hole, like the spindle hole 106. The toe of the upper assembly contacts a toe rest 2B in FIG. 10. The top part labeled $1B_1$ in FIG. 3 of the heel post 1B is rotated clockwise in FIG. 10 in the direction of the arrow D by a pivot mechanism 114 common in the shoe industry to press the upper assembly upon the toe rest and to secure the upper assembly mechanically with respect to the machine 101 (see top part $1A_1$ in FIG. 2). A pincers mechanism that includes pincers 3B (3A) and 4B (4A) is operable to pull (or draw) the upper in the direction of the toe of the upper assembly to stretch the heel part of the upper about the heel portion of the last, which heel portion is curvilinear, the pincers mechanism being adapted to pull (or draw) the upper and cause the upper to conform to the curvilinear shape at the heel portion of the last. A hold-down 5B (5A) moves into position from its retracted position in FIG. 3 into the position in FIG. 4 above the insole to establish the height position of the insole in the context of the machine 101. (The hold-down mechanism is embodied in machines in the prior art, but not precisely as used herein.) A heel post cylinder and lock 113 in FIG. 10 moves the heel post 1B (1A) upward to effect contact between the hold-down 5B (5A) and the insole. (The pivot mechanism 114 is also in use in the prior art.) At that juncture the height of the top of the insole relative to wipers 6B (6A) and 7B (7A), FIG. 5, is established. A heel pad 8B (8A) is moved into contact with and, later, in firm engagement with the upper assembly 112B (112A) at the heel portion of the assembly by mechanisms described below. The adhesive applying unit 109 includes a nozzle 110 that is operable to apply the ribbon 108 (FIGS. 7 and 8) of adhesive in a predetermined U-shaped pattern to the heel portion of the upper assembly 112B.

Figure 3:
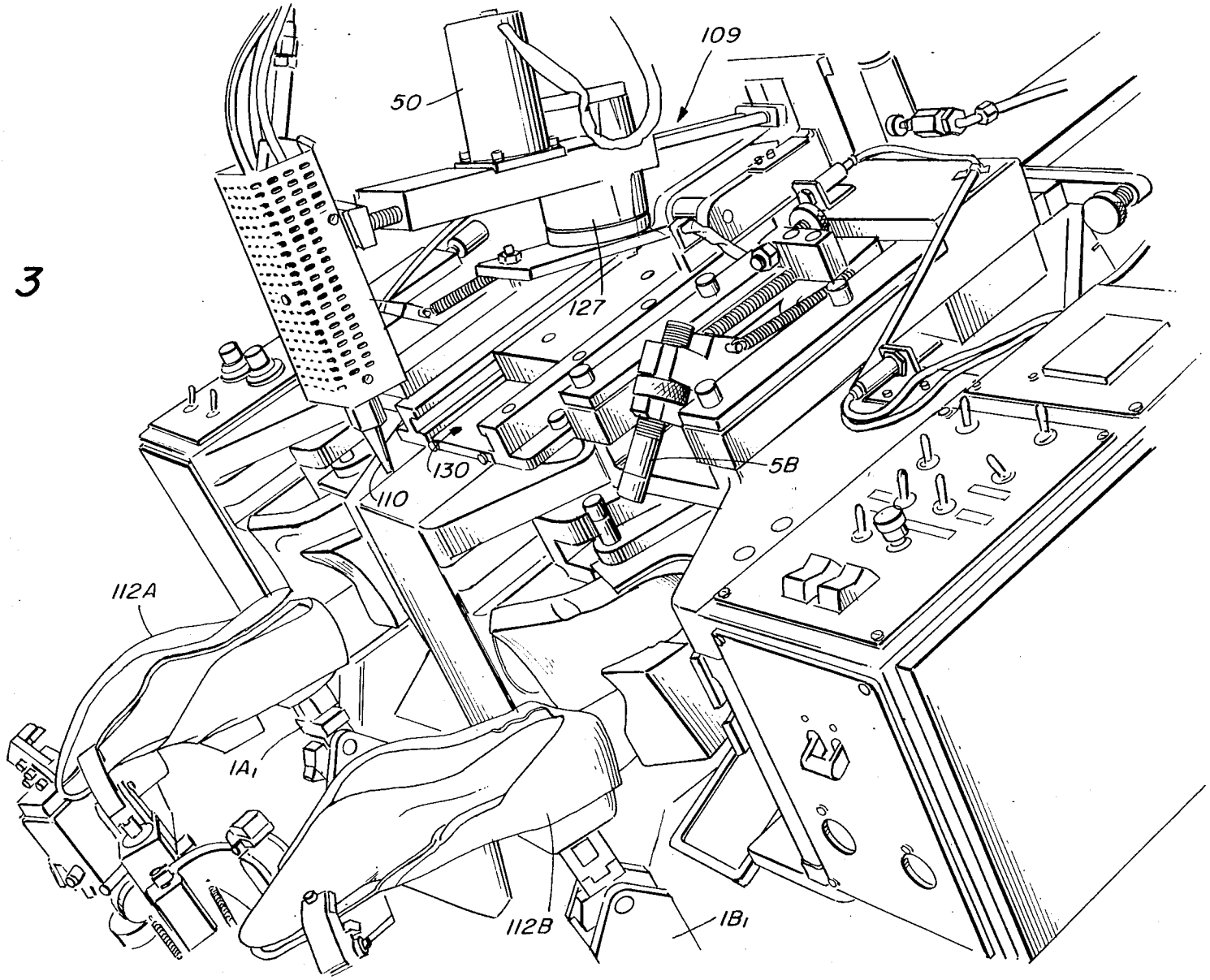
FIG. 3 is an enlarged isometric view of a portion of the machine of FIG. 1 viewed from the right side thereof to show a right hold-down device in its retracted position.

The hold-down 5B (5A) is moved forward by an air cylinder 35B (35A), the structure being such that the hold-down 5B (5A) is driven forward for a given distance and, when a predetermined position is reached, a pivot arrangement is provided whereby the hold-down 5B (5A) pivots from the acute angle in FIG. 3 to the vertical (i.e., 90-degree angle). Pivoting of the hold-down 5B is about the axis 60B in FIG. 4. The structure carrying the hold-down 5B moves to the left in FIG. 4 on slides 52B, FIGS. 4 and 5, for a predetermined distance, impelled by the air cylinder 35B. At that predetermined distance, forward movement on the ways 52B converts to pivotal motion about the pivot 60B, FIG. 4, and the hold-down 5B pivots against springs 54B, FIG. 5, from an inclined position in FIG. 3 to the vertical position in FIG. 4 wherein the hold-down 5B is positioned with its lower end just slightly above the insole (heel region) of the upper assembly 112B. Then the post 1B is moved upward until the top of the insole and the bottom of the hold-down are in firm engagement; the post 1B is then locked in that vertical position to provide a known vertical position for application of adhesive onto the heel region of the insole and wiping.

The clamping heel pad 8B (8A) is U-shaped and is made of a deformable material such as rubber (see the Kamborian et al patent for a detailed description of a pad similar to, but not identical to, the pads 8A and 8B, having a bight region to receive and engage the back of the upper assembly 112B (112A)). The pad 8B (8A) is moved forward to engage the heel portion of the upper by an air cylinder 121B in FIG. 18 (and an identical cylinder on the left side of the machine) which moves the pad 8B (8A) into engagement with the heel, as described below.

Once the pad 8B (8A) is in firm engagement of the back of the upper, the hold-down 5B (5A) retracts, a ribbon of adhesives is applied upon the insole at the heel region and then the margin 105 (FIG. 10) is wiped upon the insole 103 by wipers such as the wipers 6B and 7B in FIG. 5. The wipers 6B and 7B, as discussed in detail in the Kamborian et al patent, are pivotally connected to rotate counterclockwise and clockwise, respectively, in FIG. 5.

Spatial positioning between the nozzle 110 and the heel portion of the upper assembly 112B (112A) is critical to assure that the ribbon adhesive 108 is applied longitudinally at an appropriate position with respect to the heel portion of the upper assembly 112B (112A) despite variations in the position of the spindle hole longitudinally in the last. The mechanism to establish the longitudinal position of the heel portion of the assembly 112B (112A) relative to the nozzle 110 is an important aspect of the present invention since, as before noted, the position of the spindle hole 106 in FIG. 10 can vary as much as one-half inch from last to last as a function of manufacturing tolerances and shoe size variations. The relative positioning between the heel of the upper assembly 112B (112A) and the nozzle 110 must be established with great accuracy—and that is done by the mechanism now discussed.

Figure 5:
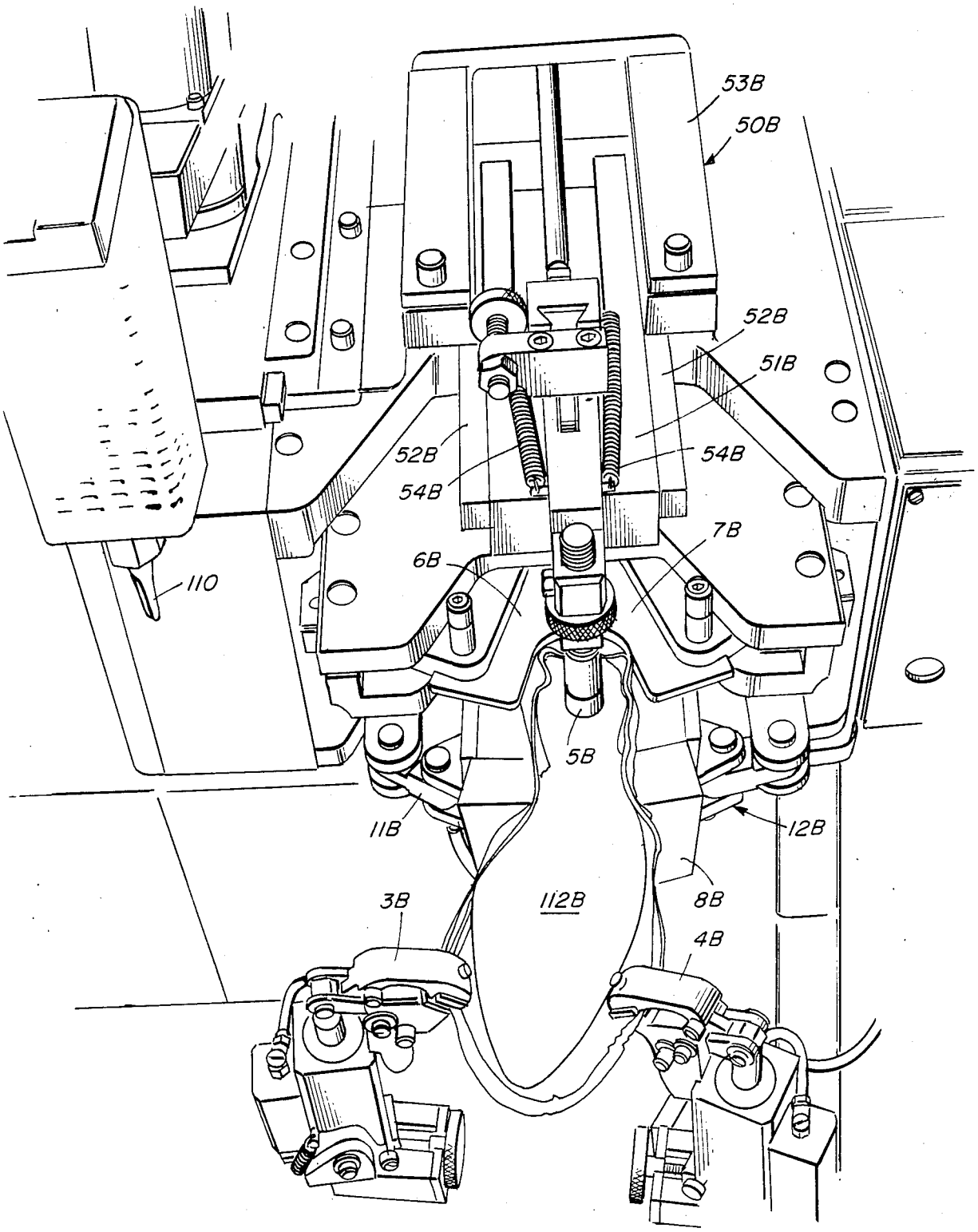
FIG. 5 is a front view of the machine parts in FIGS. 3 and 4 with the right hold-down device pressing downward on the insole, pincers grasping the forward end of the upper of the right upper assembly and a heel pad pressing the heel portion of the upper against the heel portion of the last.
Figure 6:
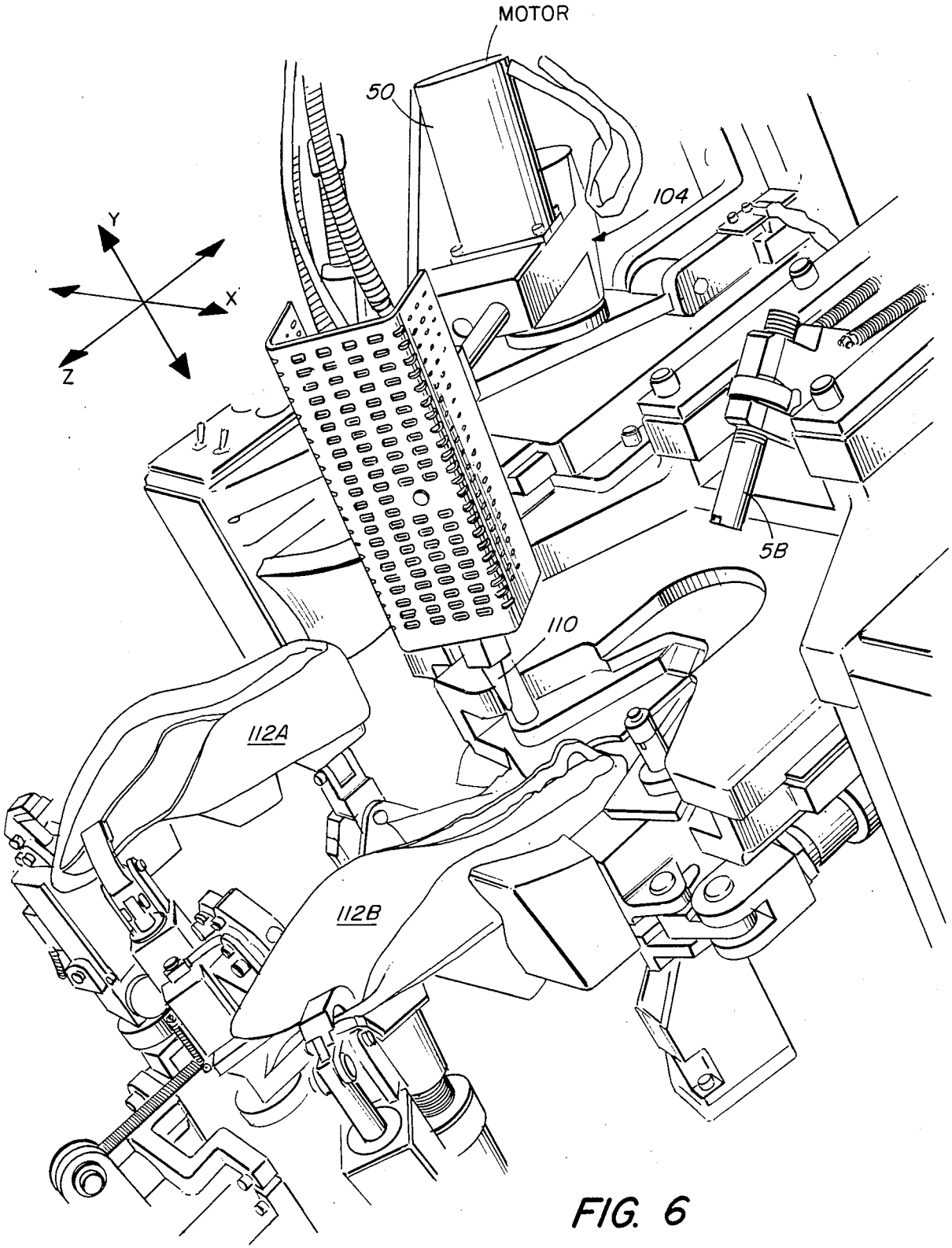
FIG. 6 is a right isometric view of the same machine parts as in the three preceding figures, with the right hold-down device retracted, the upper assembly being secured by the heel pad, and an adhesive nozzle applicator moved from its neutral position in all of the prior figures toward the right upper assembly.
Figure 7:
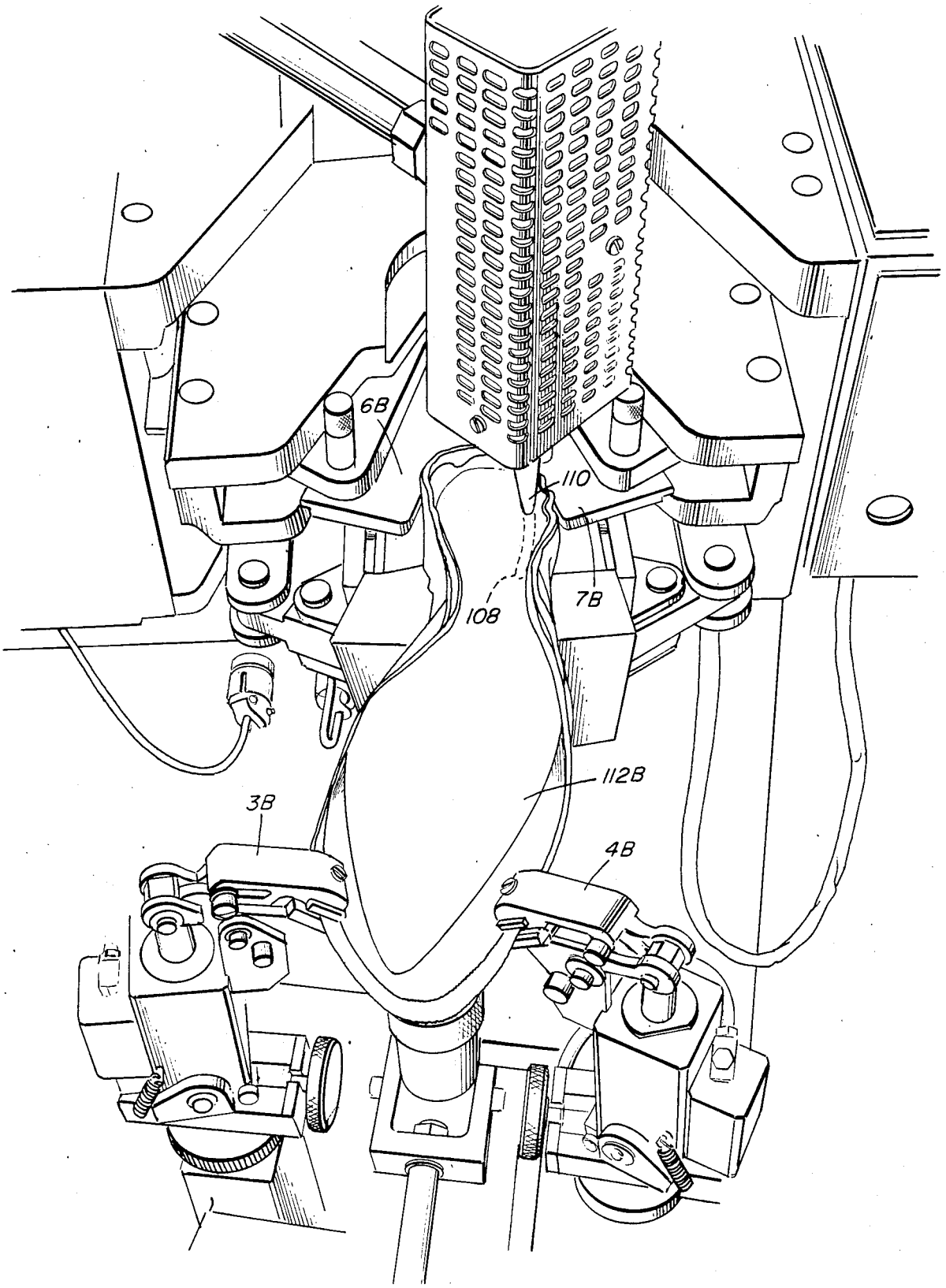
FIG. 7 is a front, enlarged view showing the adhesive nozzle applying a ribbon of adhesive onto the heel portion of the insole.
Figure 8:
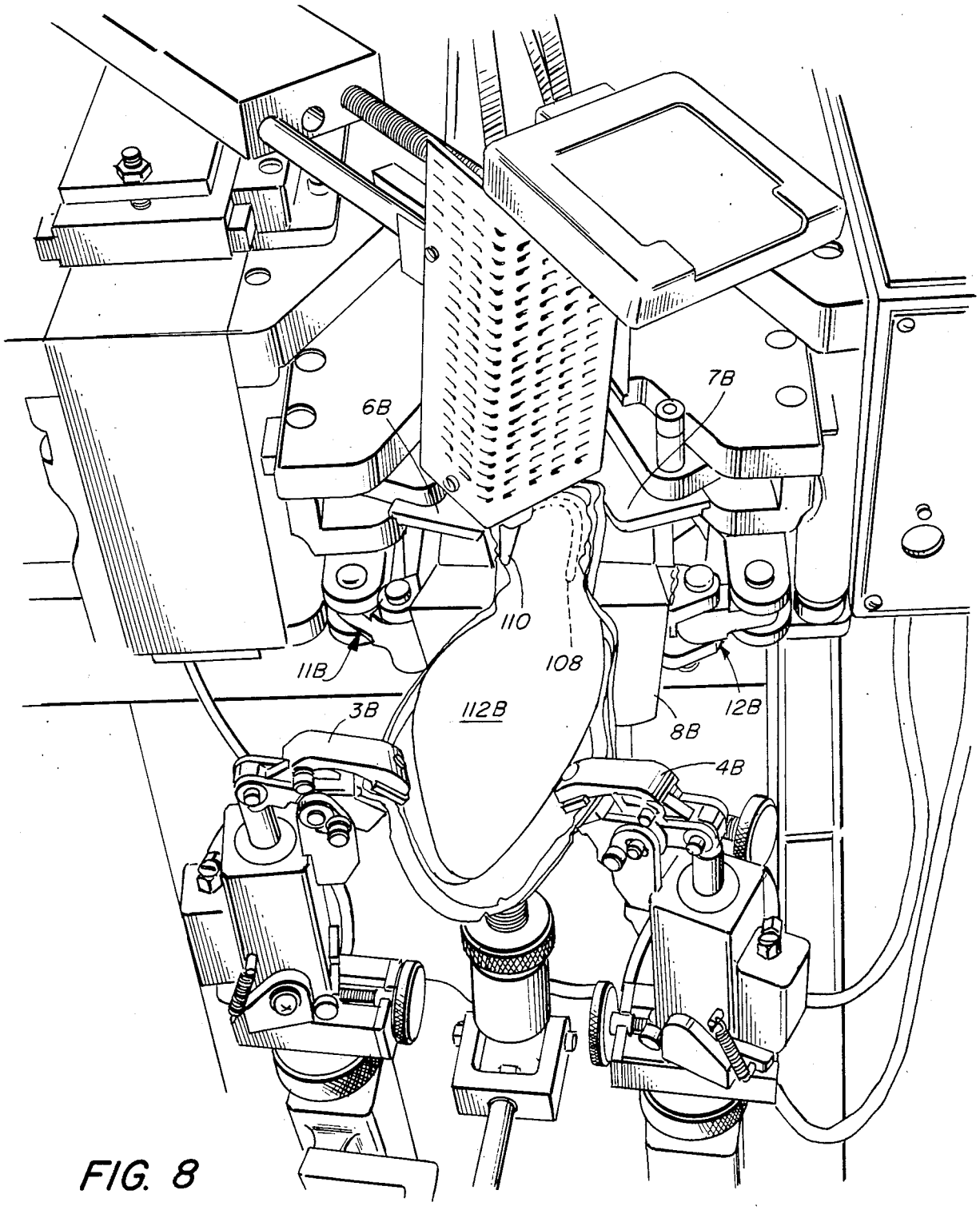
FIG. 8 is a view taken from a slight angle to the right of the view in FIG. 7 to show most of a U-shaped ribbon of adhesive on the insole.
Figure 20:
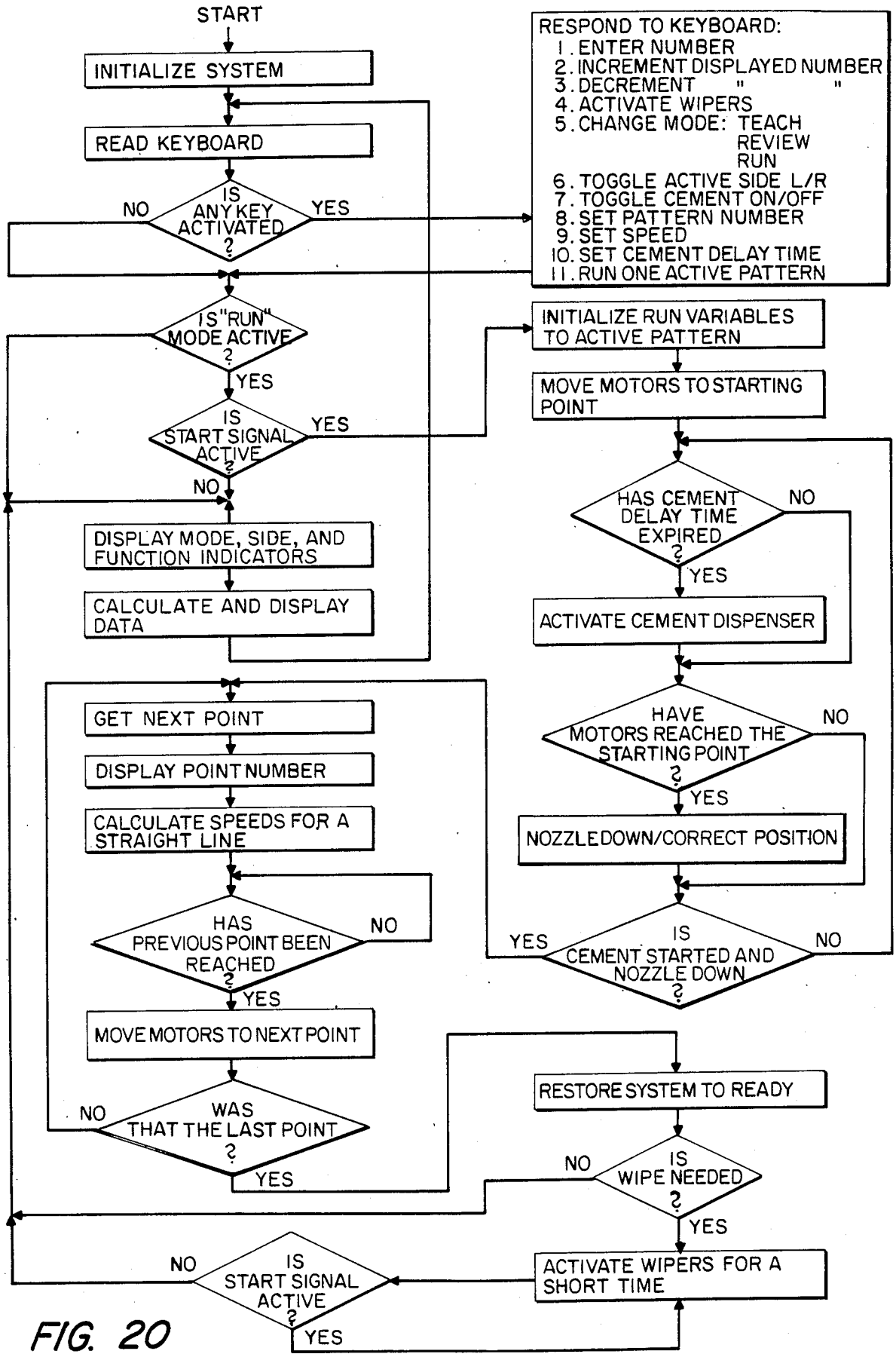
FIG. 20 is a self-explanatory flow chart for the system in the block labeled "Standard Bus Computer" in FIG. 9.

Preliminarily the combination of structures used to establish the position of the upper assembly 112B (112A) within the machine 101 relative to the nozzle 110 in fact establishes the spatial position in the X-Z plane in FIG. 1 and, more particularly, in the ± Z direction in the X-Z plane with respect to the assembly 112B (or 112A). As is noted below, what is done is to establish the forward position of the pad 8B (8A) when the pad wraps around the back portion of the upper assembly 112B (112A); from that position the relative locations of the nozzle 110 in the retracted position of FIG. 1 and the heel region onto which the ribbon of adhesive is to be deposited can be established. The nozzle 110 is then moved from the retracted position of FIGS. 1–5 to the intermediate position of FIG. 6, then to a position immediately above (about one-eighth inch) the insole of the upper assembly 112B in FIG. 7. FIGS. 7 and 8 show successive positions of the nozzle 110 as the ribbon 108 is applied onto the surface of the upwardly directed insole. In the preferred embodiment, the instructions to drive the nozzle 110 and related apparatus are given mostly by a standard bus computer 227 in FIG. 9, which includes a microprocessor programmed to perform the functions designated by the flow chart in FIG. 20, but mechanical inter-connections including cams, rods, and so forth could be employed for that purpose. The important issue here is the mechanism that permits precise identification of the relative positioning between the two prior to any position change from the rest position of the nozzle 110 toward the position at which deposition is achieved, as now explained.

It is explained above that the location of deposition of the ribbon 108 is established by locating the longitudinal position of the upper assembly 112B (112A) relative to the rest position of the nozzle 110. It should be understood that the nozzle 110 always follows about the same path between the rest position (FIGS. 1–5) and the initial depositing position. That initial depositing position varies (i.e., laterally) because of width difference due to shoe size and design and that difference can be accommodated by the program applied to standard bus computer 227. Longitudinal positioning for the nozzle and hence the ribbon 108 is more difficult.

Figure 18:
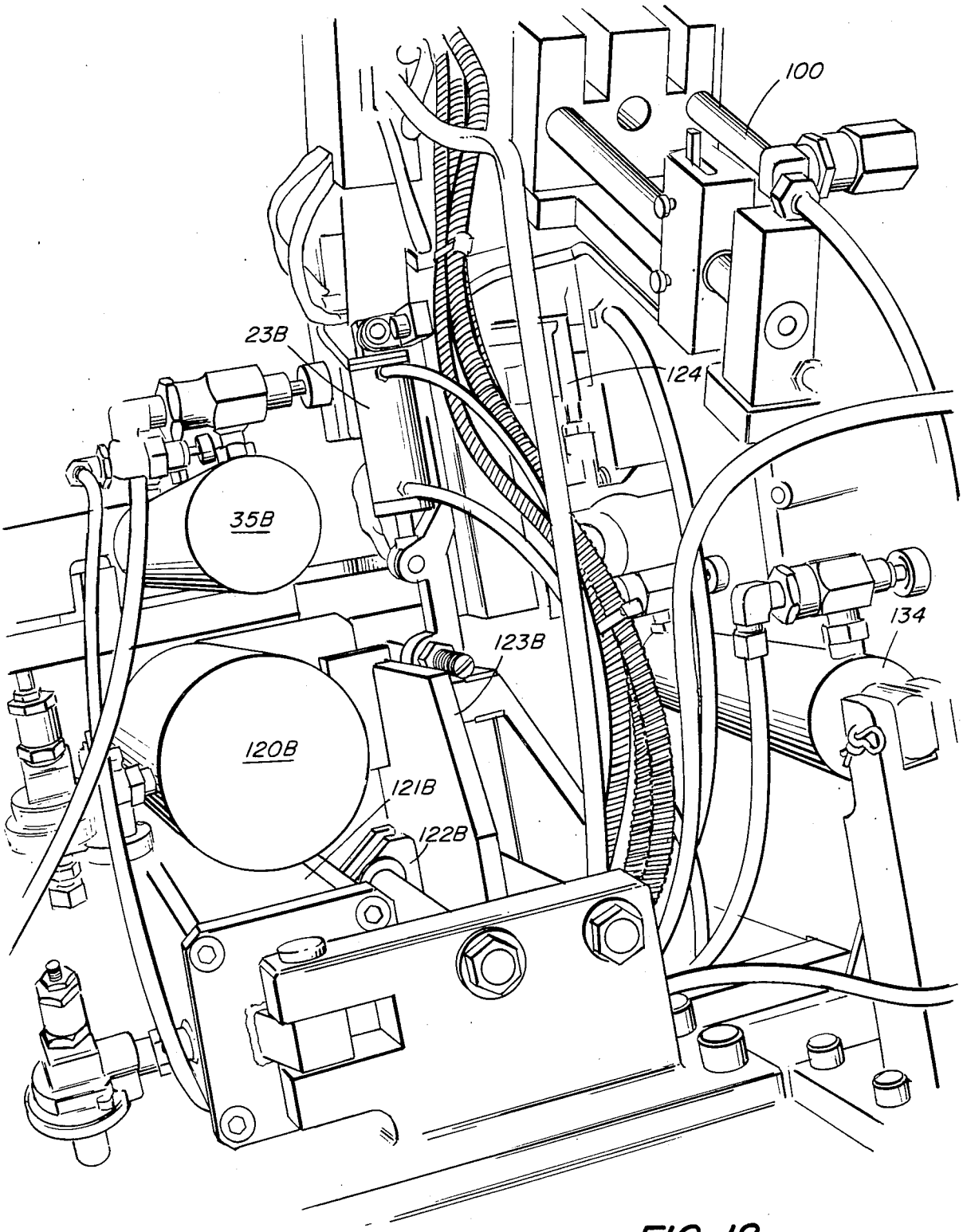
FIG. 18 is a rear isometric view looking at the right side of the machine of FIG. 1 from the back thereof.

The double-acting air cylinder 121B in FIG. 18 moves the right-side head structure of the machine 101, and hence the pad 8B and other parts on the head structure, forward to encounter the upper assembly 112B. When the pad 8B encounters the upper assembly 112B, its forward movement stops. At that juncture the relative longitudinal positions of the back 111 of the upper assembly 112B, the pad 8B and structurally-related parts are known because the back side of the concavity of the pad 8B that receives the back of the upper assembly 112B is in contact with the back 111. (It is later noted that the pad 8B moves lightly backward in the head structure to activate a proximity switch to initiate other functions.) One of the structurally-related parts is an air cylinder 21B (21A) in FIG. 16 that is rigidly and unchangeably mechanically interconnected to the pad 8B (8A), that is, the parts mechanically connected to the pad 8B (8A) act as a rigid body.

Figure 14:
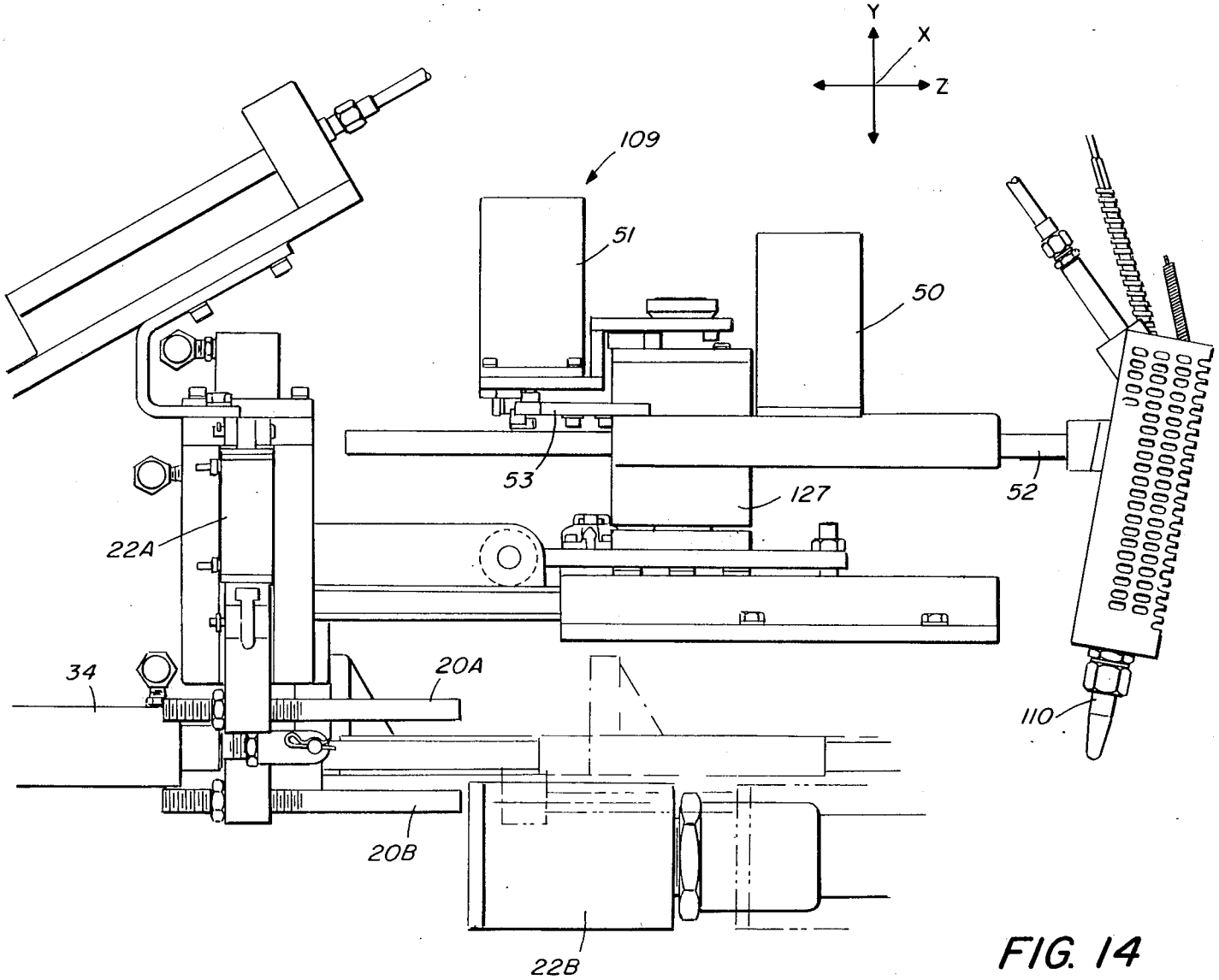
FIG. 14 is a side view of the adhesive nozzle and related parts in earlier figures.

While the pad 8B (8A) is moving forward, the nozzle 110 is stationary at its rest position shown in FIGS. 1–5. When the pad 8B (8A) has reached its full forward movement, the adhesive applicator mechanism 109 in FIG. 14 is then moved forward, that is, in the Z-direction (i.e., to the right in FIG. 14). The forward movement of the assembly 109, as explained below, is determined by the position the pad 8B (8A) reaches when it engages the heel portion of the upper assembly 112B because the adjustment rod labeled 20B (20A), FIG. 15, which is longitudinally, rigidly connected to the assembly 109, encounters the back of the air cylinder 21B (21A) in FIG. 16. The cylinder 21B (21A) is mechanically rigidly interconnected and positionally unchangeably connected to the pad 8B (8A). In fact the cylinder 21B (21A) in combination with two other air cylinders, not shown in the figures, provides necessary forces on the pad 8B (8A) to wrap the pad around the heel of the upper assembly, at which time the pad 8B (8A) moves back slightly into its holding structure to actuate a proximity switch in the block marked 230 in FIG. 9.

It will be appreciated that the rod 20B (20A) must stop the forward movement of the adhesive applicator assembly 109 to establish initial position of the nozzle 110 relative to the heel portion of the upper assembly 112B for a right shoe assembly in one action and to a left shoe assembly 112A in another action, that is, the rod 20B must be rendered effective to stop forward motion of the adhesive applicator assembly 109 at an appropriate forward position for the right upper assembly, but be rendered ineffective for that purpose when the left upper assembly is being acted upon, the rod 20A being rendered effective for the latter. The nozzle 110 must move forward in each instance a distance determined by interaction between the appropriate rod 20B (20A) striking the cylinder 21B (or 21A). To permit that eventuality, the rod 20B (20A) is movable vertically by an air cylinder 23B (23A) in FIG. 16 between the upper position of the rod 20A in FIG. 14, whose vertical position is established by the air cylinder 23A and the lower position of the rod 20B that is moved down and up by the air cylinder 23B.

Figure 16:
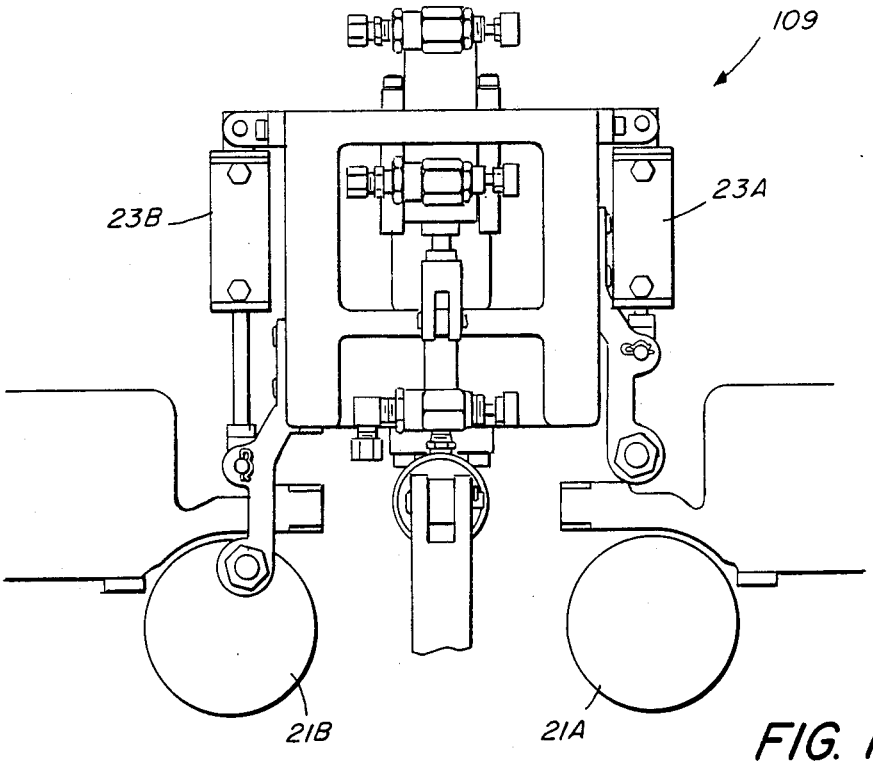
FIG. 16 is a rear elevation view taken on the line 16—16 in FIG. 15 looking in the direction of the arrows.
Figure 17:
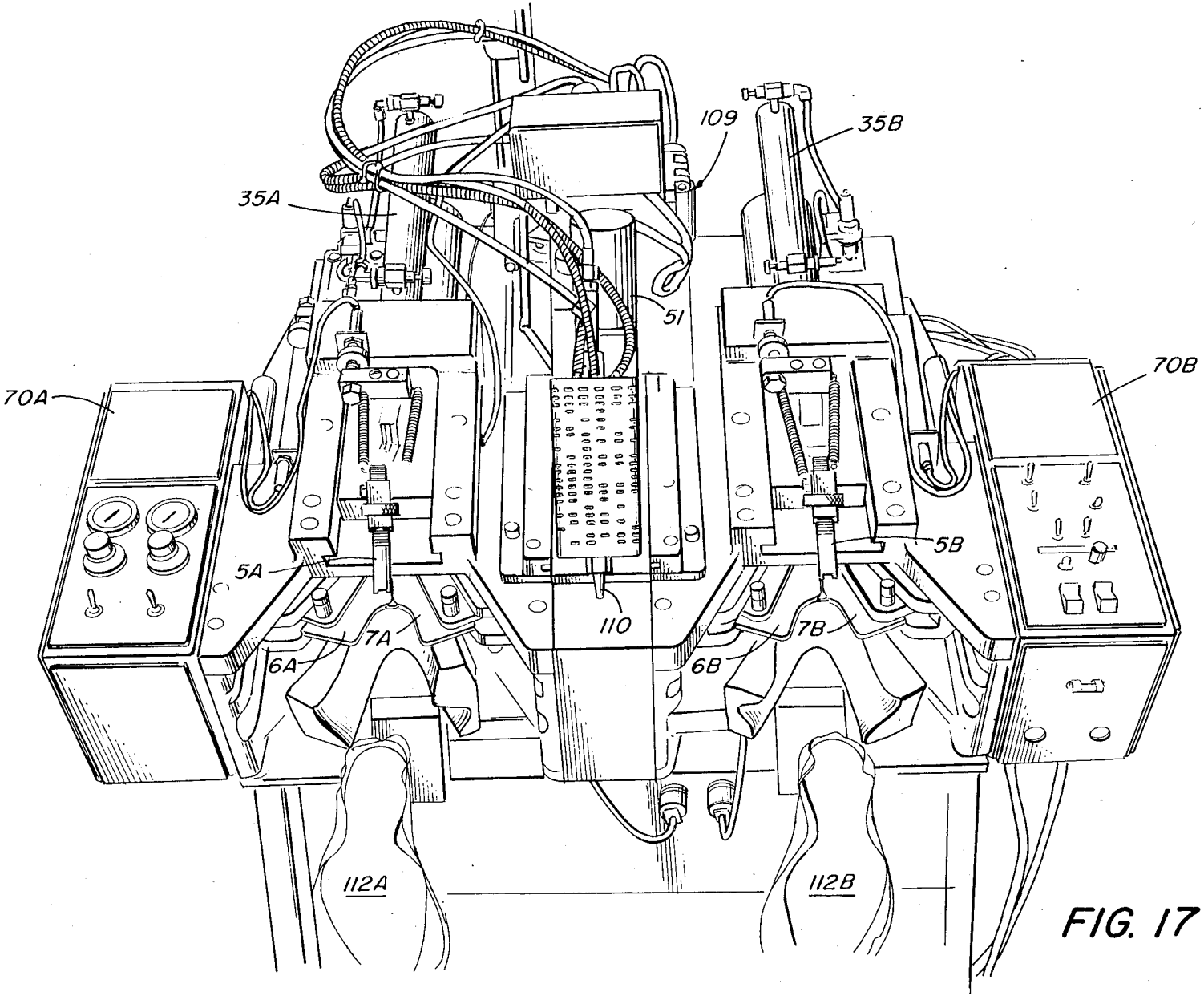
FIG. 17 is a front view looking down onto the machine of FIG. 1 from a position slightly in front of the machine.

In the upper position, the rods 20A and 20B do not encounter the backs of the air cylinders 21A and 21B, respectively, in FIG. 16 as the assembly 109 moves to the right in FIG. 14; hence, the nozzle 110 can be moved forward, that is, to the right in FIG. 14, and later can move further foward and swing into position to apply adhesive onto the insole of the appropriate assembly as now explained.

The adhesive applicator assembly 109 has a double slide arrangement: the first slide moves forward until the rod 20B (20A) strikes the back of the cylinder 21B (21A); that establishes ± Z-direction spatial interrelationship between the nozzle and the upper assembly. Thereafter the nozzle 110 moves forward on another slide and is rotatably driven by motors 251 in FIG. 9 (i.e., the motors marked 50 and 51 in FIG. 14 and FIG. 15) to the appropriate location above the insole of the respective shoe upper assembly to apply adhesive in a U-shaped pattern upon the insole. Movement of the nozzle 110 is along a path that includes a forward, sliding component effected by the electric motor 50 through a gear mechanism 52 in FIG. 15 and angular movement of the nozzle 110 to the left or right is achieved by the electric motor 51 through a gear arrangement described below. (The nozzle 110 is also moved up and down by pivoting about a pivot point 125 in FIG. 4, as later discussed.) The trajectory of the nozzle 110 after its initial forward position has been established in the manner described above, is established by the computer 227 which may be programmed in accordance with the flow chart shown in FIG. 20 to establish the position of the U-shaped adhesive ribbon 108 such that the back 108A, FIG. 11, of the ribbon bears an acceptable Z-direction (i.e., fore and aft) position relative to the back 111 of the upper assembly 112 in FIG. 11, the upper 104 having been previously appropriately stretched about the curvilinear heel portion of the last 102 (FIG. 10), as discussed later with reference to FIGS. 10 and 11.

Figure 9:
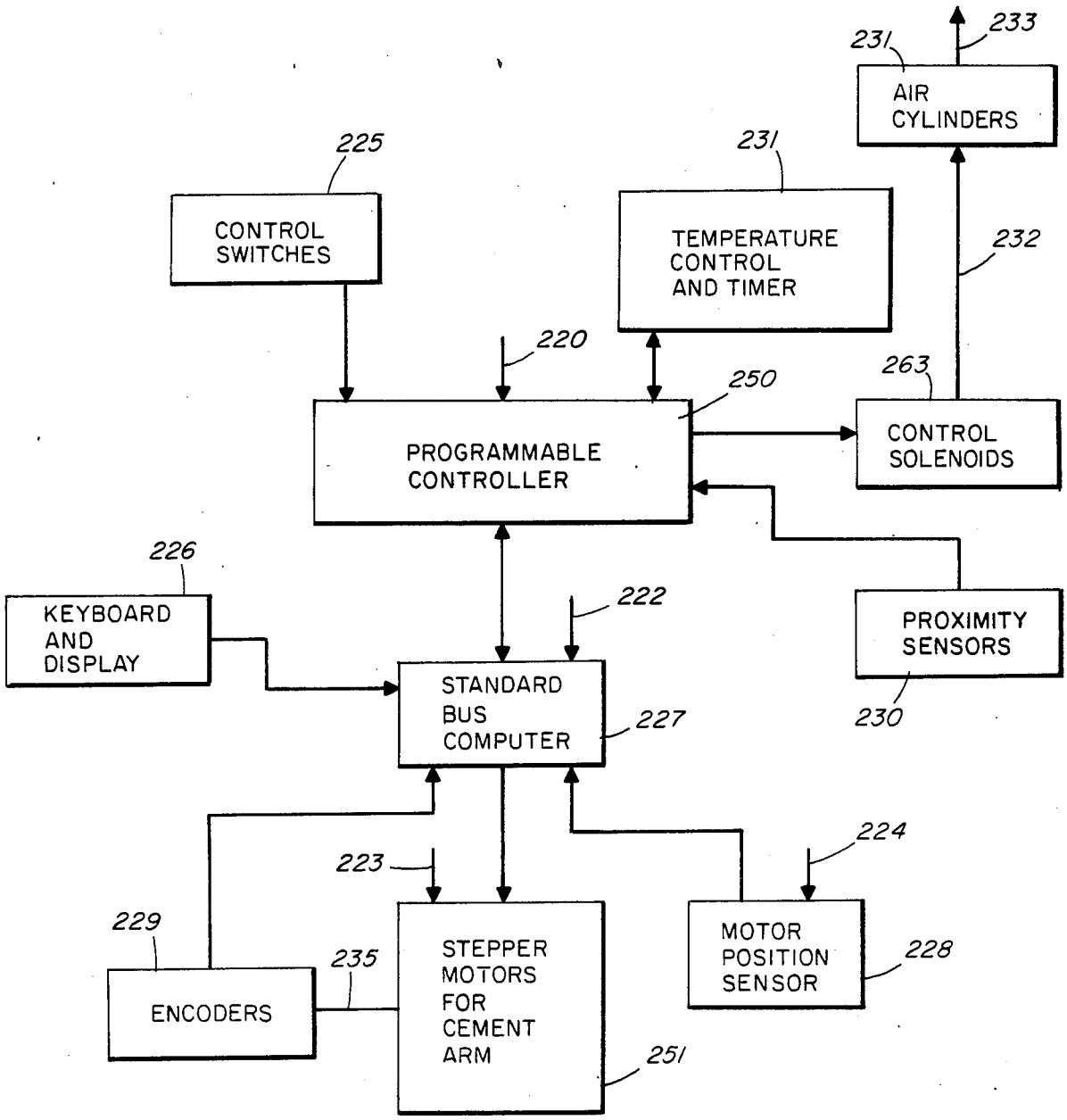
FIG. 9 is a block diagram representation of electrical controls and devices in the machine of FIG. 1.

An air cylinder 134 in FIGS. 14 and 18 moves the adhesive assembly 109 forward until the shaft 20B (20A) strikes the back of the air cylinder 21B (21A). The air cylinder 124 in FIG. 18 pivots the nozzle about the pivot 125 in FIG. 4, thereby lowering the nozzle 110. At that juncture the position of the adhesive nozzle 110, relative to the heel portion of the upper assembly 112B (112A) is known. From that point, the computer 227 in FIG. 9 provides the needed signals to guide the nozzle 110 along an appropriate trajectory to apply the U-shaped ribbon unto the insole of the upper assembly.

Figure 15:
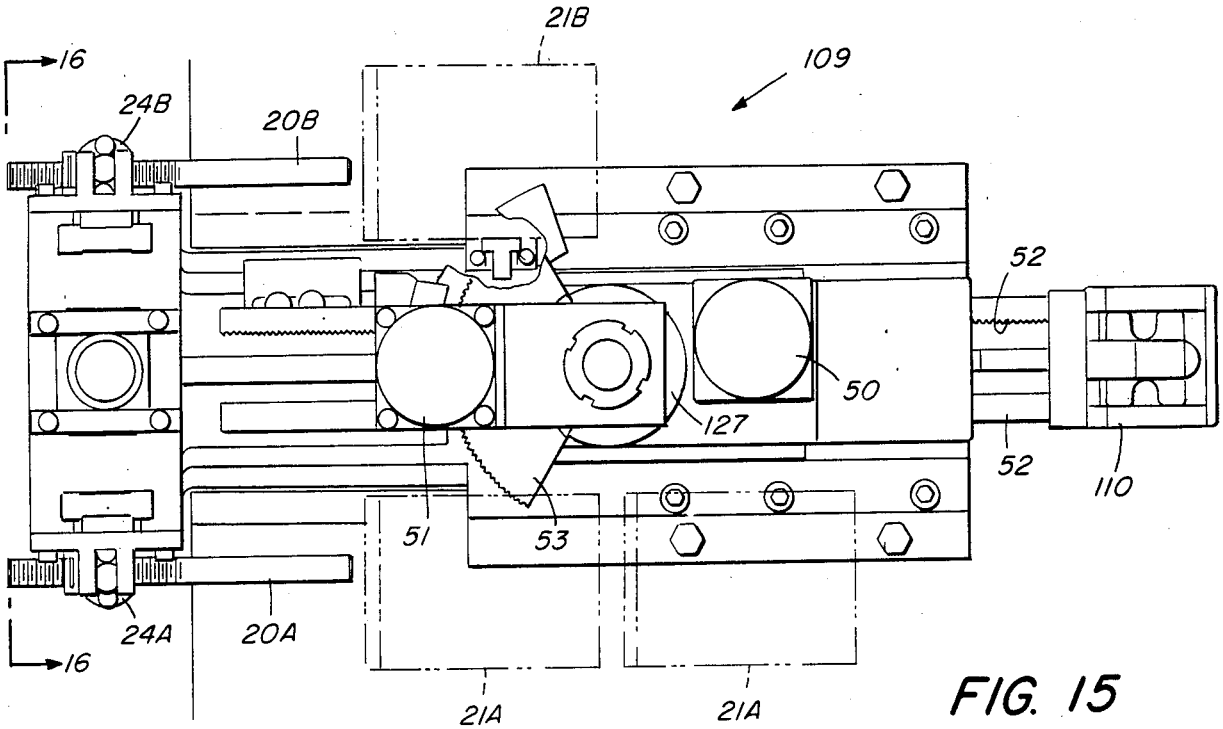
FIG. 15 is a top view of the parts in FIG. 14.

The drive mechanism to achieve the particular trajectory includes the motor 50 which drives the nozzle 110 to the left and right in FIGS. 14 and 15 and which may be called a Z-axis motor drive. The motor 50 has a small cylindrical gear on its shaft which engages the linear gear (i.e., a rack and pinion) on one of two shafts 52 in FIG. 15 to drive the shafts 52 (and hence the nozzle 110) to the right or left, as needed. The motor 51 rotates the nozzle 110 clockwise and counterclockwise in FIG. 15, such rotation being achieved by a small cylindrical gear on the shaft of the motor 51 interacting with an angular segment 53. Clockwise rotation of the shaft of the motor 51 in FIG. 15 moves the nozzle (or nozzle assembly) 110 counterclockwise; counterclockwise rotation of the shaft of the motor 51 moves the nozzle 110 clockwise in FIG. 15, the segment 53 being pivoted at its apex about a pivot mechanism 127 in FIG. 4. The motors 50 and 51 may be stepping motors or servomotors.

As is well known in this art, the back 111 of the upper 103 is sewn and usually there is a variation among uppers at 111 in terms of the precise shape thereof. Typically the upper is pulled (or drawn forward) in the plus Z-direction along the longitudinaly axis. According to the present teaching, however, the direction of pull of the wipers 3A (3B) and 4A (4B) to the right in FIGS. 11 and 12 (where the pincers are labeled 3 and 4) can be adjusted through a wide angle C in FIGS. 10 and 13 to correct for malformation of the back of the upper (see the malformation marked 104A in FIG. 13) in respect to the back of the heel portion of the last 102.

Figure 13:
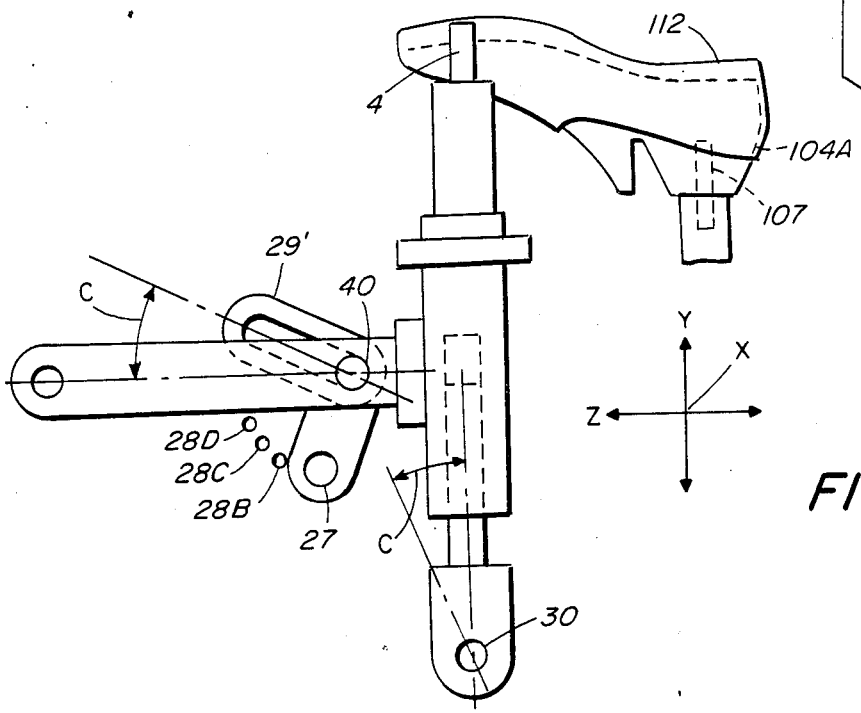
FIG. 13 is a side view of the machine parts in FIG. 12.

The mechanism to achieve the pulling (or drafting) is shown in detail in FIGS. 12 and 13 wherein the pincers 3 and 4 grasp the forward part of the upper 104 (FIG. 11) and an air cylinder 36 applies a force to the left (plus Z-direction) in FIG. 12 to stretch the upper about the heel portion of the last to close the space 104A between the broken line and the upper due to the malformation referred to earlier. The tilt angle C and hence the direction of pull is adjusted by a spring-loaded knob 27, FIG. 13, and shaft (not shown), the shaft being received by four (or more) holes 28B–28D, the first hole in FIG. 13 being covered and being the hole in which the shaft is inserted in the figure. Actual angular adjustment is achieved through cams 29 and 29' in FIG. 12 which effect angular movement of the pulling assembly in FIGS. 12 and 13 about a pivot 30 and hence establish the precise angle of pull (or draw) of the upper with respect to the last. Once the upper is positioned and stretched about the last, the adhesive ribbon 108 (FIG. 11) is applied and the upper is wiped upon the insole by rotating the wipers 6B and 7B in FIG. 5 (the left-hand wipers are shown in some of the figures but are not labeled).

Wiping is achieved by a cylinder 120B in FIG. 18 which actuates both wipers 6B and 7B which move in scissor fashion to press the margin at the heel region onto the adhesive-laden insole. As is well known in this art, the respective wipers are interconnected to the actuating cylinder in a way that causes one wiper of a pair to pivot counterclockwise and the other wiper of the pair to pivot clockwise. Wiping is conventional, but is is important to note the role of the hold-down 5B (5A) in establishing the vertical position of the top of the insole at the heel region to permit proper wiping—as well as proper application of the adhesive ribbon. A number of matters noted earlier are taken up in some detail in the paragraphs below.

Figure 4:
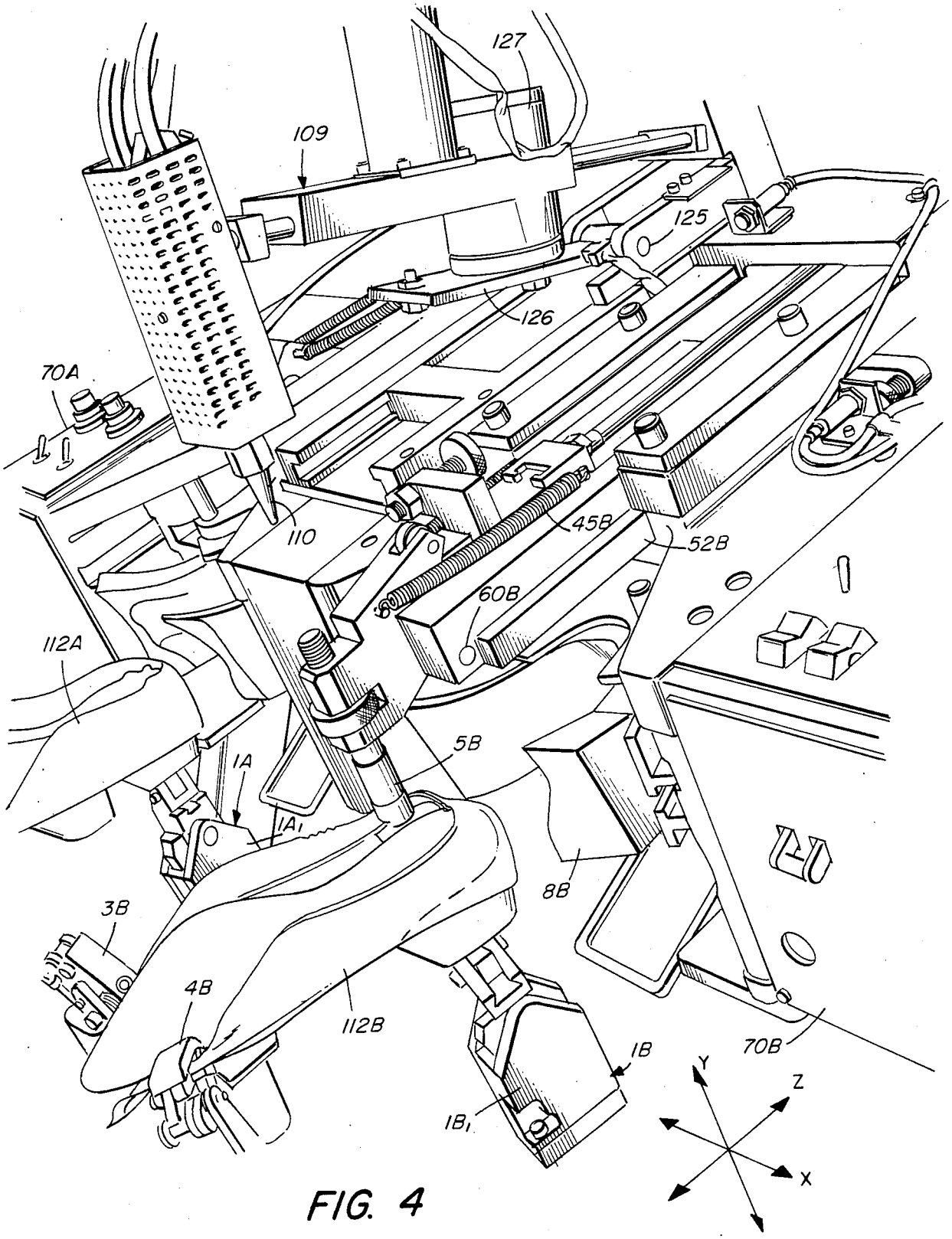
FIG. 4 is a view similar to that in FIG. 3 with the right hold-down device moved forward and disposed immediately above the insole at the heel portion of the upper assembly.

The top part 1B$_1$ of the post 1B in FIGS. 3 and 4 pivots in the clockwise direction in FIG. 10 to press the toe of the upper assembly 112 onto the toe rest 2B. The mechanism by which this is accomplished is a wedge and roller arrangement within the post 1B whereby the wedge is driven upward by an air cylinder, forcing the roller to cause the top part 1B$_1$ to pivot clockwise in FIG. 10. The scheme is found in machines of general use.

The hold-down 5B in FIG. 5 is moved forward and back by action of the double-acting air cylinder 35B in FIG. 18, the hold-down 5B being carried by a structure 50B whose slides 52B slide in ways in a structure 53B, the whole unit being marked 50B. The hold-down 5B, as above noted, pivots at 60B in FIG. 4 to assume the vertical position in that figure. (The left side of the machine 101 has an identical mechanism.)

FIG. 18 is included herein mostly to show a number of double-acting cylinders and related parts that serve to drive the machine parts discussed earler, it being noted that the figure shows the right side of the machine in FIG. 1 and, except for the adhesive applicator 109, these parts are duplicated on the other (or left) side. The cylinder 35B activates the hold-down 5B, as above noted. The cylinder 120B furnishes force to the wipers 6B and 7B in FIG. 5. The cylinder 121B effects forward and rearward movement of the right-side head structure of the machine 101; the head structure rides on ways and carries the pad 8B, wipers 6B and 7B, hold-down 5B and so forth. It is this movement of the head structure that brings the pad 8B into contact with the back of the upper assembly 112B in FIG. 1 to permit derivation of position information by the adhesive applicator 109. Later the pad 8B is wrapped around the heel of the upper assembly 112B by action of the air-cylinder 21B in FIG. 16. through the linkages marked 11B and 12B in FIG. 5. Once the pad 8B engages the back of the upper assembly 112B and then moves lightly into the head structure, a mechanical brake consisting of a pad 122B in FIG. 18 and another pad (not shown) are pressed by an air cylinder (not shown) against a flat plate 123B; the pad 122B and the other like pad function as a caliper brake when activated by a double-acting, pancake air cylinder through brake arms having appropriate pivotal (free floating) interconnections, a structure found in many machines long in use. The left side of the machine has a similar arrangement.

Turning now to the adhesive applicator 109 in FIG. 3, initial fore and aft movement is effected by the double-acting air cylinder 134 in FIG. 18 along ways 130 in FIG. 3. The cylinder 23B, as above discussed, is attached to move fore and aft therewith. The double acting air cylinder 124 in FIG. 18 pivots a plate 126 in FIG. 4 counterclokwise and clockwise in the Y-Z plane about the pivot 125 in FIG. 4, it being noted here and elsewhere that almost all the elements in FIG. 4 are tilted about thirty degrees from the X-Z (i.e., horizontal) plane, but the fiction that the two coincide is maintained here to ease the explanation since the tilting is purely to render the working area in and around the upper assemblies 112A and 112B accessible to the machine operator.

Figure 19:
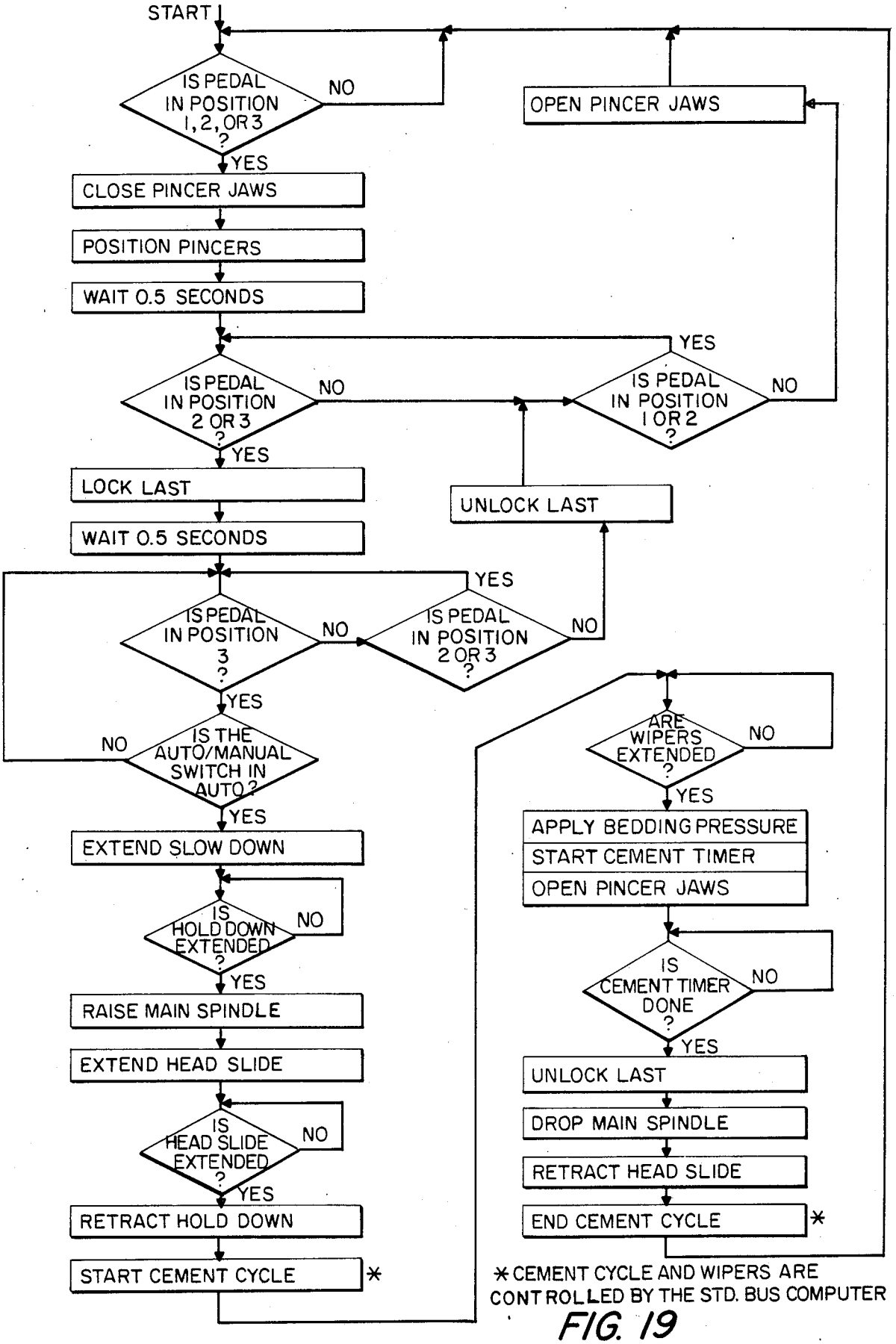
FIG. 19 is a self-explanatory flow chart for the system in the block labeled "Programmable Controller" in FIG. 9.

With reference to FIG. 9, all the functions discussed herein are controlled either by a programmable controller 250 or the standard bus computer 227. Indeed, the computer 227 is activated to perform its functions in guiding the nozzle 110 by the controller 250. The computer 227 provides control of the movement of the nozzle 110 except for the tilting mentioned above about the pivot 125, FIG. 4, by the cylinder 124, FIG. 18, and the extrusion and heating of the hot-melt adhesive, the latter functions being under the control of the controller 250 in accordance with the flow chart in FIG. 19. In FIG. 9, leads 220, 222, 223 and 224 are input power voltages. A keyboard and display 226 represents a four-digit numerical display and sixteen-button software-defined input to the computer 227. The stepper block designated 251, as before noted, includes the adhesive applicator driver motors 50 and 51 in other figures. There are six inductive proximity sensors represented in a block 230, three on each side of the machine 101: one sensor is associated with the pad 8B (8A), as above noted; one is associated with the hold-down 5B (5A) and serves to activate a solenoid in the control solenoids block 263 to cause the spindle 1B (1A) to rise to raise the upper assembly 112B (112A) into contact with the hold-down 5B (5A); and one, through a solenoid in the block 263, serves to unlock the air cylinder in the block 113 in FIG. 10 to apply bedding (i.e., upward) pressure to the upper asssembly 112B (112A) when the wipers are in the outward or wiping position thereby to flatten the heel portion of the upper assembly. Temperature of the adhesive applied by the nozzle 110 is controlled by a temperature controller and timer 231. The control switches 225 are a reset switch, two abort switches (activated by knee actuators 71A and 71B in FIG. 1), and manual/automatic switches for each side of the machine 101. Encoders 229 are part of the motors 251, the line shown in 235 being a mechanical connection, as are, also, lines 232 and 233, the remaining lines being electrical connections. Motor position sensors 228 are Hall-effect vane position switches to sense home position of the stepper motors 251. The computer 227 not only establishes the initial position of adhesive onto the insole, it establishes, as well, the width of the U-shaped ribbon to accommodate different shoe sizes.

A serial sequence of events is given in this paragraph with respect to the right side of the machine 101. The upper assembly 112B is placed onto the last pin of the heel post or spindle 1B. The right foot pedal 72B (72A) is depressed in the first of the three positions, closing one sensor switch (i.e., a proximity switch) in the proximity sensor block 230 in FIG. 9, activating one of the control solenoids represented by the block labeled 263 in FIG. 9; the solenoid activates an air cylinder in block 231 to close the pincers 3B and 4B. The next depression closes a second proximity switch which activates a second solenoid to activate the air cylinder 36 in FIG. 12, which stretches the upper and another air cylinder that immediately thereafter pivots the toe of the upper assembly 112B onto the toe rest (see the pivot mechanism 114 in FIG. 10). The third and final position of the foot pedal 72B activates another solenoid that causes the hold-down 5B to move forward; then the spindle 1B is raised (see the heel post air cylinder and lock 113 in FIG. 10) to bring the top of the insole in contact with the bottom of the hold-down 5B. Then the head structure of the right side of the machine 101 comes forward to bring the byte region of the pad 8B into contact with the back of the upper 112B; the pad 8B slides back into the head structure to activate a proximity sensor in the block 230 (as discussed elsewhere herein) causing the pad activator 121B to close the pad 8B about the heel of the assembly 112B; the hold-down 5B is retracted, cement is applied at the heel region of the upper assembly 112B, and then the heel is wiped by the wipers 6B and 7B. When the wipers are in the wiping position, the lock in the heel post cylinder (block 113 in FIG. 10) may be released to permit flattening the heel of the upper assembly onto the last.

Electrical signals to achieve the various foregoing tasks are inputted by switches in panels 70A and 70B in FIG. 1, which are not mirror images of one another, but are, rather, individual electrical input controllers and contain some of the elements shown in FIG. 9 and discussed above.

Further modifications of the invention herein disclosed will occur to persons skilled in the art and all such modifications are deemed to be within the scope of the invention as defined by the appended claims.

What is claimed is:

1. A heel lasting machine comprising two stations, each station to receive a footwear upper assembly that includes a last, an insole on the last bottom and an upper draped about the last with a margin extending upwardly from the insole, said last having a spindle hole, each said station comprising a heel post having a last pin that is received by said spindle hole, pincers means operable to grasp the margin at each side of the upper assembly and operable to pull the upper toward the toe thereof to stretch the heel part of the upper about the heel portion of the last, which heel portion is curvilinear, said pincers means being adjustably adapted to pull the upper at an angle to conform the heel of the upper assembly to the heel portion of the last, a toe rest to receive the toe portion of the upper assembly, means to pivot the upper assembly to press the upper assembly mechanically with respect to the toe rest, a hold-down operable to move from a retracted position to a position slightly above the insole, means to move the last upward to effect contact between the hold-down and the insole, a heel pad assembly that includes a heel pad and heel pad actuating means that is operable to move the heel pad into contact with and later into firm physical engagement with the upper assembly at the heel portion of the last;

said machine further including a single adhesive applying unit that includes a nozzle operable to apply a ribbon of adhesive in a predetermined pattern to the heel portion of the upper assembly alternately at said each station of the machine;

said machine including means to establish an exact spatial relationship between the nozzle and the heel portion of each upper assembly to assure that said ribbon is applied at an appropriate position with respect to the heel portion of said each upper assembly despite variations as to the position of said thimble hole in the last of said each upper assembly.

2. A heel lasting machine according to claim 1 in which the adhesive applying unit is movable longitudinally forward and rearward with respect to the upper assembly at each said station and includes a fluid actuator to move the nozzle longitudinally forward and rearward with respect to the upper assembly at each said station.

3. A heel lasting machine according to claim 2 that includes means to establish an initial forward position of the adhesive applying unit relative to the heel pad at each said station when the heel pad is in engagement with the upper assembly and hence the relative position of the upper assembly at each said station relative to the nozzle and that further includes means to establish a trajectory of the nozzles from the initial forward position to the heel region of the upper assembly as well as means to drive the nozzle along said trajectory.

4. A heel lasting machine according to claim 1 in which the adhesive applying unit includes means to effect physical contact with the heel pad assembly at each said station to establish longitudinal spatial relationship between the nozzle and the upper assembly at each said station to assure that the ribbon is deposited at an appropriate position.

5. A heel lasting machine according to claim 4 in which said pattern is a U-shaped pattern of adhesive deposited on the insole at the heel portion of the upper assembly.

6. A heel lasting machine according to claim 5 that includes means to modify said U-shaped pattern to accommodate size differences of the upper assembly.

7. A heel lasting machine according to claim 5 that includes means to modify positioning of the U-shaped pattern to accommodate a left-foot upper assembly or a right foot assembly.

8. A heel lasting machine according to claim 1 in which the pincers means is adapted to modify the direction of said pull to stretch the upper about the heel portion of the last despite malformation of the heel part of the upper.

9. A heel lasting machine having two stations, each station to receive a footwear upper assembly that includes a last, an insole on the last bottom and an upper draped about the last with a margin extending upward from the insole, said last having a spindle hole, said machine comprising:

a single adhesive applying unit having a nozzle to deliver adhesive as a ribbon pattern to both upper assemblies at the heel regions thereof; said each station comprising a last pin that is received by the spindle hole of an upper assembly and serves as part of a mechanism to secure the upper assembly to the machine; and positioning means to establish relative spatial positioning between the nozzle and the heel region with respect to the said each station to assure proper positioning of the ribbon pattern with respect to the upper assembly at each said station despite variations in the position of the spindle hole.

10. A heel lasting machine according to claim 9 in which the nozzle has a retracted position and initial forward position and in which the positioning means locates the longitudinal position of the footwear upper assembly relative to the initial forward position of the nozzle and then guides the nozzle along a predetermined path between said initial forward position and its initial depositing position, the positioning means thereafter acting to guide the nozzle along an appropriate path to assure said proper positioning of the ribbon pattern.

11. A heel lasting machine according to claim 10 in which the adhesive applying unit includes a double slide arrangement that carries the nozzle, the first slide being one that moves longitudinally forward to establish longitudinally the initial forward position of the nozzle relative to the heel region of the upper assembly onto which the adhesive ribbon is to be applied, the other slide thereafter being activated to move the nozzle along said appropriate path.

12. A heel lasting machine according to claim 11 in which the adhesive applying unit includes electric motor drive means to apply sliding motion to said other slide, and hence to the nozzle, as well as rotatable motion thereto along a trajectory from said initial forward position to an appropriate location with respect to the insole of the respective footwear upper assembly.

13. A heel lasting machine according to claim 12 that includes computer means programmed to control the electric motor drive means to establish said trajectory of the nozzle to said appropriate location and, thereafter, along a U-shaped path to deposit a U-shaped adhesive ribbon.

14. A heel lasting machine according to claim 13 in which the electric motor drive means includes a first motor to apply linear slide motion to the nozzle and a second motor to apply clockwise and counterclockwise rotatable motion to the nozzle.

15. A heel lasting machine according to claim 11 in which the positioning means includes means to establish longitudinally said initial forward position with respect to the respective footwear upper assembly, of the two footwear upper assemblies, to which the ribbon of adhesive is about to be applied.

16. A heel lasting machine according to claim 15 in which the means to establish comprises a pair of adjustment rods connected to the adhesive applying unit, one rod of the pair of rods being associated with one station of the two stations and being adapted to establish the forward longitudinal position of the nozzle at said initial forward position with respect to the associated footwear upper assembly installed in the one station, the second rod of the pair of rods being associated with the other of the two stations and being adapted to establish the forward longitudinal position of the nozzle at said initial forward position with respect to the associated footwear upper assembly installed in said other of the two stations.

17. A heel lasting machine according to claim 16 in which the means to establish includes means to render said one rod effective to stop forward motion of the first slide with respect to said associated footwear upper assembly installed in the one station while the second rod of the pair is rendered ineffective for that purpose and to render said second rod effective to stop forward motion of the first slide with respect to said associated footwear upper assembly installed in the second station while said one rod is rendered ineffective for that purpose.

18. A heel lasting machine according to claim 11 in which the adhesive applying means includes pivot means to permit the nozzle to be moved up and down with respect to said heel region of the upper assembly.

19. In a heel lasting machine having two stations to receive two footwear upper assemblies, each footwear upper assembly including a last, an insole on the last bottom and an upper draped about the last, said last having a spindle hole whose longitudinal position varies from last to last, said lasting machine being operable to apply a precisely positioned ribbon of adhesive onto the heel region of each of the two footwear upper assemblies, despite the variation in position of the spindle hole, said heel lasting machine comprising:

a single adhesive applying unit having a nozzle to deliver the ribbon of adhesive to each of the two footwear upper assemblies at the heel region of each footwear upper assembly of the two footwear upper assemblies; and positioning means to establish spatial positioning between the nozzle and the heel region of said each footwear upper assembly of the two footwear upper assemblies to assure proper positioning of the ribbon pattern with respect to each of the footwear assemblies.

* * * * *